US006600470B1

(12) United States Patent
Tsuda

(10) Patent No.: US 6,600,470 B1
(45) Date of Patent: Jul. 29, 2003

(54) LIQUID-CRYSTAL PANEL DRIVING DEVICE, AND LIQUID-CRYSTAL APPARATUS

(75) Inventor: Atsunari Tsuda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/394,528

(22) Filed: Sep. 10, 1999

(30) Foreign Application Priority Data

Sep. 11, 1998 (JP) ..... 10-259029
Jul. 9, 1999 (JP) ..... 11-196621

(51) Int. Cl.[7] ..... G09G 3/36
(52) U.S. Cl. ..... 345/89; 345/87; 345/102; 349/162
(58) Field of Search ..... 345/89, 119, 87; 349/162

(56) References Cited

U.S. PATENT DOCUMENTS 5,489,918 A * 2/1996 Mosier ..... 345/89
5,748,164 A * 5/1998 Handschy et al. ..... 345/89
6,295,109 B1 * 9/2001 Kubo et al. ..... 345/119

FOREIGN PATENT DOCUMENTS

JP 57-154291 * 9/1982

OTHER PUBLICATIONS

Weber, M.F., "23.3: Retroreflecting Sheet Polarizer," SID 92 Digest, 1992, pp. 427–429.

* cited by examiner

*Primary Examiner*—Dennis-Doon Chow
(74) *Attorney, Agent, or Firm*—Oliff & Berridge PLC

(57) ABSTRACT

The invention relates to driving a transflective liquid-cystal panel in such a manner as to increase a contrast ratio during a transmissive-type display time while appropriately maintaining the brightness during a reflective-type display. The liquidcrystal panel includes a Y driver circuit and an X driver circuit for supplying an applied voltage having an effective value of a magnitude corresponding to the gray scale level indicated by gray scale data to a liquid crystal element, and a driver control circuit for switching the setting of each magnitude of an effective value of an applied voltage with respect to each gray scale level in the X driver circuit to a setting for a reflective-type display in response to the non-switching on of a light source and to a setting for a transmissive-type display in response to the switching on of the light source.

27 Claims, 17 Drawing Sheets

LIQUID-CRYSTAL PANEL DRIVING DEVICE, AND LIQUID-CRYSTAL APPARATUS

BACKGROUND OF THE INVENTION

1. Field of Invention

The present invention relates to driving devices for driving liquid-crystal panels for use with a TFD (Thin Film Diode) driving method, a TFT (Thin Film Transistor) driving method, and a simple-matrix driving method, and to a liquidcrystal device comprising a liquid-crystal panel and a driving device. More particularly, the present invention relates to an device for driving a transflective liquid-crystal panel which comprises a polarizer, a transflector, and a light source. The device being capable of serving dual purposes of a reflective-type such that a display is produced by reflecting external light, and of a transmissive-type such that a display is produced by transmitting light-source light.

2.Description of Related Art

In a conventional transmissive-type liquid-crystal panel using TN (Twisted Nematic) liquid-crystal, STN (Super-Twisted Nematic) liquid-crystal, and the like, generally, relatively satisfactory brightness is obtained by light-source light. On the other hand, in order that the contrast ratio to be sufficient, a construction is employed in which a shading film called a black mask or a black matrix is formed in a net form around an opening area opposing each pixel on an opposite substrate in order to separate each of the adjacent pixels, preventing mixing of colors between the pixels when a color display using color filters is produced, and further, the contrast ratio is increased regardless of a color display and a black-and-white display.

FIGS. 20 and 21 respectively show an enlarged sectional view and an enlarged plan view of the opposite substrate within a screen display area where a shading film which separates each pixel is formed in this manner and color filters of RGB are formed in each pixel. In FIG. 20, RGB color filters 501 are formed on the surface of an opposite substrate 500 on a side facing the liquid crystal in such a way that the RGB color filters 501 correspond to each pixel. A shading film 502 made of a shading metal or a shading organic film is formed in the spacing of the opening area of each pixel, that is, in the boundary of the color filters 501. Further, a transparent electrode 504 is formed on the color filters 501 via an overcoat (OC) layer 503, which transparent electrode 504 forms a data line or scanning line (in the case of a liquid-crystal panel of a TFD active-matrix driving method, a simple-matrix driving method, or the like), an opposite electrode (in the case of a liquid-crystal panel of a TFT active-matrix driving method), and the like.

As its planar layout, there are the mosaic arrangement, the delta arrangement, and the stripe arrangement, as shown in FIGS. 21A, 21B, and 21C, respectively. In FIGS. 21A, 21B, and 21C, shading film 502*a,* 502*b,* and 502*c* are formed in the boundary areas (that is, the hatched areas in the figures) of the color filters 501*a,* 501*b,* and 501*c,* respectively.

In this type of transmissive-type liquid-crystal panel, the shading films which separate each pixel in this manner makes it possible to generally obtain a very high contrast ratio of, for example, about 100:1. Here, the "contrast ratio" refers to the ratio of the display luminance when a driving voltage is not applied to a liquid crystal, to the display luminance when a driving voltage is applied in the normally white mode, or in the normally black mode.

On the other hand, in a conventional reflective-type liquid-crystal panel using a TN liquid-crystal or a STN liquid-crystal, since the brightness of a display depends on the intensity of external light, generally, a display which is as approximately bright as the brightness in the case of a transmissive-type display cannot be obtained. That is, in a reflective-type liquid-crystal device, insufficient brightness is considered to be more problematical than an insufficient contrast ratio. For this reason, it is a common practice that a shading film is not formed on an opposite substrate like in the case of the above-mentioned transmissive-type liquid-crystal panel.

FIGS. 22 and 23 respectively show an enlarged sectional view and an enlarged plan view of an opposite substrate within a screen display area where a shading film is not formed in this manner and RGB color filters are formed in each pixel. Components which are the same as those in FIGS. 20 and 21 are given the same reference numerals, and accordingly, descriptions thereof have been omitted.

In the reflective-type liquid-crystal panel, since a shading film which separates each pixel in this manner is not formed, the amount of light which passes through the opposite substrate is increased by an amount corresponding to that in which light is not shielded by the shading film, causing the display to be bright. However, because there is no shading film, mixing of colors occurs when a color display using color filters is made. Also, since leakage of light (loss of white) occurs in the spacing (non-opening area) between opening areas for adjacent pixels regardless of color display and black-and-white display, a contrast ratio of, for example, about 10:1 is obtained.

In the manner as described above, in the case of a reflective-type liquid-crystal panel which produces a display using external light, in a dark environment, the display darkens and becomes difficult to see with a decrease in the amount of light. In contrast, in the case of a transmissive-type liquid-crystal panel, such as the above mentioned, which produces a display using a light source such as a backlight, power consumption is increased by an amount corresponding to the light source regardless of whether it is a bright environment or a dark environment, and the transmissive-type liquid-crystal panel is not suitable, in particular, for a portable display device which is operated by a battery.

Therefore, in recent years, a transflective liquid-crystal panel which can be used for both a reflective-type and a transmissive-type has been developed. This transflective liquid-crystal panel produces, mainly in a bright environment, a reflective-type display by controlling the amount of light which is output from the display screen for each pixel by using an optical element, such as a liquid crystal, a polarized-light separator, and so on, disposed on the light path while external light which enters from the display screen is reflected by a transflective film provided inside the device, whereas, mainly in a dark environment, a transmissive-type display is produced by controlling the amount of light which is output from the display screen for each pixel by using an optical element, such as a liquid crystal, a polarized-light separator, and so on, described above, while light-source light is emitted by a built-in light source, such as a backlight, from the rear side of the transflective film.

A liquid-crystal panel driving device for driving various types of liquid-crystal panels, such as a reflective-type, a transmissive-type, or a transflective-type, constructed in the above manner generally comprises driver circuits, such as data-line driving circuits, and scanning-line driving circuits, which supply a data signal and a scanning signal to a plurality of data lines and a plurality of scanning lines, disposed on a substrate on which liquid-crystal elements are formed, respectively, in such a manner as to correspond to display data. This driver circuit is formed on a substrate on which liquid-crystal elements are formed, or provided externally to the liquidcrystal panel. Also, such a liquid-crystal panel driving device comprises a driver control circuit for controlling the driver circuit by supplying, to the driver circuit, (i) various control signals for controlling a voltage value and a supply timing in a data signal and a scanning signal, and (ii) a data signal of a predetermined format, which corresponds to display data and which is based on display data, and the like. Such a liquid-crystal panel driving device further comprises a control power supply circuit for supplying various control potentials, such as a predetermined high potential, low potential, or reference potential, to the driver circuit. The driver control circuit and the control power supply circuit are generally formed as IC circuits and are provided externally to the liquid-crystal panel.

In particular, when the display data is gray scale data, for example, a voltage value (crest value) and an applied time (pulse width) of a data signal are varied in response to each gray scale level by the driver control circuit and driver circuit described above so that the effective value of the applied voltage applied to the liquid crystal is varied in response to the gray scale level. In this case, the setting (that is, the relationship between the gray scale level and the effective value of the applied voltage, or the varying characteristics of the effective value of the applied voltage with respect to the gray scale level) of each magnitude of the effective value of the applied voltage with respect to each gray scale level in the driver circuit, is set to a single setting in advance according to the characteristics of each liquid-crystal panel irrespective of the reflective-type, the transmissive-type, and the transflective-type.

However, in the conventional transflective liquid-crystal panel, similarly to the case of the above-mentioned reflective-type liquid-crystal panel, a construction (see FIGS. 22 and 23) is generally employed in which a shading film which separates each pixel is not provided on an opposite substrate. With such a construction, when a reflective-type display is produced, a display having a contrast ratio of about 10:1 is obtained similarly to the case of the reflective-type liquid-crystal panel. However, when a transmissive-type display is produced, since light-source light exits from the spacing of pixels with no shading film (non-opening area), only a contrast ratio much lower than the above contrast ratio can be obtained. For this reason, in the conventional transflectivetype liquid-crystal panel, there is a problem in that a satisfactory contrast ratio cannot be obtained during the transmissive-type display time. Furthermore, when the display mode is switched from the reflective-type display mode to the transmissive-type display mode, the contrast ratio is decreased greatly at the instant of switching. Alternatively, when the display mode is conversely switched from the transmissive-type display mode to the reflective-type display mode, the contrast ratio is increased greatly at the instant of switching. For this reason, there is also a problem in that incongruity of vision is given to a user at the time of switching of the display mode.

If, for the transflective liquid-crystal panel, a construction (FIGS. 20 and 21) is employed in which a shading film which separates each pixel is provided on an opposite substrate in a manner similar to the above-mentioned transmissive-type liquid-crystal panel, a satisfactory contrast ratio is obtained at the transmissive-type display time. However, since the display darkens at the time of the reflective-type display which depends on the intensity of external light, such a liquid-crystal panel is not used in practice.

As described above, in the liquid-crystal panel driving device, the setting of each magnitude of the effective value of an applied voltage for each gray scale level in the driver circuit is set to a single setting in advance according to the characteristics of each liquid-crystal panel irrespective of whether it is the reflective-type, transmissive-type, or transflective-type. Consequently, by adjusting this setting, it is possible for the transflective-type liquid-crystal panel to respond to the demand for increasing the brightness during a reflective-type display time, such as the brightness described above. It is also possible to respond to the demand for increasing the contrast ratio during the transmissive-type display time. However, there is a problem in that a single setting which satisfies these two demands simultaneously is not available in practice even in a construction in which a shading film is not provided on an opposite substrate.

SUMMARY OF THE INVENTION

It is one aspect of the present invention, which has been achieved in view of the above-described problems, to provide a liquid-crystal panel driving device capable of increasing the contrast ratio during a transmissive-type display time while appropriately maintaining the brightness during a reflective-type display time in a transflective-type liquid-crystal panel, and further, which is capable of decreasing the difference between the contrast ratio during the reflective-type display time and the contrast ratio during the transmissive-type display time, and a liquid-crystal device comprising such a liquid-crystal panel and such a driving device.

Therefore, the present invention provides a liquid-crystal panel driving device for driving a transflective-type liquid-crystal panel having a liquid-crystal element which has a liquid crystal held between a pair of substrates and in which the origination state of the liquid crystal can be varied according to the effective value of an applied voltage applied to the liquid crystal; a pair of polarized-light separation devices disposed with the liquid-crystal element interposed therebetween; and a light source for causing light-source light to enter the liquid-crystal element via the polarized-light separation devices, a reflective-type display is produced by causing external light to be reflected via the liquid-crystal element and the polarized-light separation devices when the light source is not switched on, and a transmissive-type display is produced by causing the light-source light to be transmitted through the liquid-crystal element and the polarized-light separation devices when the light source is switched on, the liquid crystal panel driving device comprising: a power supply device for supplying to the liquid-crystal element the applied voltage having an effective value of a magnitude corresponding to the gray scale level indicated by gray scale data; and a switch for switching the setting of each magnitude of the effective value for each gray scale level in the power supply device to a setting for a reflectivetype display in response to the non-switching on of the light source and to a setting for a transmissive-type display in response to the switching on of the light source.

According to the liquid-crystal panel driving device of the present invention, the power supply device supplies an applied voltage having an effective value corresponding to a gray scale level indicated by gray scale data to a liquidcrystal element. Therefore, when the light source is not switched on, if the alignment state of the liquid crystal of the liquid-crystal element varies in accordance with the effective value of this applied voltage, the transmittance with respect to the external light reflected via the liquid-crystal element and the polarized-light separation device varies according to the alignment state. For this reason, the reflected light of the external light, attenuated in response to the gray scale level, is output from the display screen, that is, a reflective-type display is produced. In addition, when the light source is switched on, if the alignment state of the liquid crystal of the liquid-crystal element varies in accordance with the effective value of this applied voltage, the transmittance with respect to the light-source light to be transmitted through the liquid-crystal element and the polarized-light separation device varies according to the alignment state. For this reason, the light-source light attenuated in response to the gray scale level is output from the display screen, that is, a transmissive-type display is produced. Here, in particular, the switch switches the setting of each magnitude of the effective value of the applied voltage for each gray scale level in the power supply device to a setting for a reflective-type display in response to the non-switching on of the light source or to a setting for a transmissive-type display in response to the switching on of the light source.

Therefore, in comparison with a setting (a single setting) in which there is no distinction between that for a reflective-type display and that for a transmissive-type display as in the conventional case, if the setting for the reflective-type display is such a setting as to make the brightness bright and the setting for the transmissive-type display is such a setting as to increase the contrast ratio, a reflective-type display which is brighter than in the conventional case can be produced when the light source is not switched on, and at the same time, when the light source is switched on, a transmissive-type display can be produced at a contrast ratio higher than in the conventional case. In particular, for the trade-off of slightly decreasing the contrast ratio, the setting for the reflective-type display can be made such as to make the brightness correspondingly bright, and at the same time, for the trade-off of slightly reducing the brightness, the setting for the transmissive-type display can be made such as to increase the contrast ratio correspondingly.

In addition, when there is no shading film in the liquid-crystal element (see FIGS. 22 and 23), if the setting for the reflective-type display and the setting for the transmissive-type display are performed so that, by increasing the contrast ratio during the transmissive-type display time or by decreasing the contrast ratio during the reflective-type display time, the difference between the contrast ratio during the reflective-type display time and the contrast ratio during the transmissive-type display time is decreased to that in the conventional case and, preferably, is of the same degree, the variation of the contrast ratio when the light source is switched on or when it is not switched on can be decreased to such a degree so as not to be very conspicuous or noticeable.

As a result of the above, the brightness and the contrast ratio are appropriately adjusted by the liquid-crystal panel driving device of the present invention in both the reflective-type display mode and the transmissive-type display mode, and further, the variations of the contrast ratio and the brightness when these display modes are switched are not visually conspicuous, and a congruous display which is very easy to see can be realized by the transflective-type liquid-crystal panel.

The "magnitude of the effective value of the applied voltage" may be, for example, a voltage value itself of an applied voltage, such as a crest value when a pulse-shaped voltage signal having a predetermined pulse width is applied, or may be a voltage applied time such as a pulse width when a pulse-shaped voltage signal having a predetermined crest value is applied, or may be a two-dimensional applied-voltage density in a screen display area, such as a ratio of the number of pixels, to which a voltage for the total number of pixels in a very small block formed of a plurality of pixels, is applied. That is, when any publicly known gray scale display method is employed, in the transflective-type liquid-crystal panel, the present invention functions effectively, and the above-described operations and effects which are characteristic of the present invention can be obtained.

In one aspect of the liquid-crystal panel driving device of the present invention, the liquid-crystal element further comprises a plurality of data lines, disposed on the substrate, to which a data signal is supplied, and a plurality of scanning lines, disposed on the substrate, to which a scanning signal is supplied, the applied voltage being applied to the liquid crystal for each liquid-crystal portion in each pixel in such a manner as to correspond to at least one of the data signal and the scanning signal which are supplied via the data line and the scanning line, respectively. The power supply device comprises a data-signal supply device for supplying to the data line the data signal having a pulse width corresponding to the gray scale level. The switch switches the setting of each pulse width of the data signal with respect to each gray scale level in the data-signal supply device to a setting for a reflective-type display in response to the non-switching on of the light source and to a setting for a transmissive-type display in response to the switching on of the light source, thereby switching the setting of each magnitude of the effective value.

According to this aspect, the data-signal supply device supplies to the data line a data signal having a pulse width corresponding to the gray scale level. Thereupon, an applied voltage is applied to the liquid crystal of the liquid-crystal element for each liquid crystal portion in each pixel in such a manner as to correspond to at least one of the data signal and the scanning signal supplied via the data line and the scanning line, respectively. Here, in particular, when the switch switches the setting of each pulse width of the data line with respect to each gray scale level in the data-signal supply device to a setting for a reflective-type display in response to the non-switching on of the light source or to a setting for a transmissive-type display in response to the switching on of the light source, the setting of each magnitude of the effective value of the applied voltage is switched to a setting for a reflective-type display or to a setting for a transmissive-type display. Therefore, by using the period of the data signal obtained by pulse-width-modulating (PWM) gray scale data, a bright reflective-type display can be produced when the light source is not switched on, and when the light source is switched on, a transmissive-type display can be produced at a high contrast ratio. Further, the variation of the contrast ratio when the light source is switched on or when it is switched off can be decreased to such a degree so as not to be very conspicuous or noticeable.

In this aspect, the switch may comprise a first pulse generator for generating a first pulse signal for gray scale control, formed of a plurality of pulses arranged in correspondence with the intervals of the gray scale level which is a reference for the setting of the pulse width for the reflective-type display; second pulse generator for generating a second pulse signal for gray scale control, formed of a plurality of pulses arranged in correspondence with the intervals of the gray scale level which is a reference for the setting of the pulse width for the transmissive-type display; and a pulse signal switch for selectively supplying the first pulse signal for gray scale control to the data-signal supply device in response to the non-switching on of the light source and for selectively supplying the second pulse signal for gray scale control to the data-signal supply device in response to the switching on of the light source.

With such a construction, the first pulse signal for gray scale control is generated by the first pulse generator, whereas the second pulse signal for gray scale control is generated by the second pulse generator. Then, in response to the non-switching on of the light source, the first pulse signal for gray scale control is selectively supplied to the data-signal supply device by the pulse signal switch. Alternatively, in response to the switching on of the light source, the second pulse signal for gray scale control is selectively supplied to the data-signal supply device by the pulse signal switch. Therefore, a relatively simple switching operation by the pulse signal switch makes it possible to quickly and reliably switch between the reflective-type display mode and the transmissive-type display mode.

In another aspect of the liquid-crystal panel driving device of the present invention, the liquid-crystal element further comprises a plurality of data lines, disposed on the substrate, to which a data signal is supplied, a plurality of scanning lines, disposed on the substrate, to which a scanning signal is supplied, the applied voltage being applied to the liquid crystal for each liquid-crystal portion in each pixel in such a manner as to correspond to at least one of the data signal and the scanning signal which are supplied through the data line and the scanning line, respectively. The power supply device comprises data-signal supply device for supplying to the data line the data signal having a pulse width corresponding to the gray scale level, and scanning-signal supply device for supplying to the scanning line the scanning signal having a predetermined width. The switch switches the setting of a crest value of the scanning signal in the scanning-signal supply device to a setting for a reflective-type display in response to the non-switching on of the light source and to a setting for a transmissive-type display in response to the switching on of the light source, thereby switching the setting of each magnitude of the effective value.

According to this aspect, the data-signal supply device supplies a data signal having a pulse width corresponding to the gray scale level to the data line. At the same time, the scanning-signal supply device supplies a scanning signal having a predetermined width to the scanning line. Thereupon, an applied voltage is applied to the liquid crystal of the liquid-crystal element for each liquid-crystal portion in each pixel in such a manner as to correspond to at least one of the data signal and the scanning signal which are supplied via the data lines and the scanning lines, respectively. Here, in particular, when the switch switches the setting of the crest value of the scanning signal in the scanning-signal supply device to a setting for a reflective-type display in response to the non-switching on of the light source or to a setting for a transmissive-type display in response to the switching on of the light source, the setting of each magnitude of the effective value of the applied voltage is switched to a setting for a reflective-type display or to a setting for a transmissive-type display. Therefore, by using the magnitude of the voltage value of the applied voltage based on the difference between the data-signal voltage and the scanning-signal voltage, a bright reflective-type display can be produced when the light source is not switched on, and when the light source is switched on, a transmissive-type display can be produced at a high contrast ratio. Further, the variation of the contrast ratio when the light source is switched on and when it is switched off can be decreased to such a degree so as not to be very conspicuous or noticeable.

In this aspect, the switch may comprise a first control voltage supply for supplying a first control voltage which is a reference for the setting of the crest value for the reflective-type display; a second control voltage supply for supplying a second control voltage which is a reference for the setting of the crest value for the transmissive-type display; and a control voltage switch for selectively supplying the first control voltage to the scanning-signal supply device in response to the non-switching on of the light source and for selectively supplying the second control voltage to the scanning-signal supply device in response to the switching on of the light source.

With such a construction, the first control voltage supply supplies a first control voltage, whereas the second control voltage supply supplies a second control voltage. Then, in response to the non-switching on of the light source, the control voltage switch selectively supplies the first control voltage to the scanning-signal supply device. Alternatively, in response to the switching on of the light source, the control voltage switch selectively supplies the second control voltage to the scanningsignal supply device. Therefore, a relatively simple switching operation by the control voltage switch makes it possible to quickly and reliably switch between the reflective-type display mode and the transmissive-type display mode.

In another aspect of the liquid-crystal panel driving device of the present invention, the switch switches the setting of the magnitude of the effective value in such a way that in the setting for the reflective-type display, the transmittance of the external light in the liquid-crystal device becomes relatively large over the entire region of the gray scale level, and that in the setting for the transmissive-type display, the transmittance of the light-source light in the liquid-crystal device becomes relatively small over the entire region of the gray scale level.

According to this aspect, since, in the reflective-type display mode, the transmittance of the external light in the liquid-crystal device becomes relatively large over the entire region of the gray scale level by switching using the switch, the display becomes bright over the entire gray scale. Conversely, in the transmissive-type display mode, since the transmittance of the light-source light in the liquid-crystal device becomes relatively small over the entire region of the gray scale level by switching using the switch, the display becomes dark over the entire gray scale. Therefore, when, in particular, there is no shading film in the liquid-crystal element (see FIGS. 22 and 23), the difference in the contrast ratio and in the brightness between during the reflective-type display time and during the transmissive-type display time can be reduced as well, and the variation of the contrast ratio and the brightness when the light source is switched on or when it is switched off can be decreased to such a degree so as not to be very conspicuous or noticeable.

In another aspect of the liquid-crystal panel driving device of the present invention, the switch switches the setting of the magnitude of the effective value in such a way that, in the setting for the reflective-type display, the variation of the transmittance of the external light in the liquid-crystal device with respect to the variation of the gray scale level becomes relatively small, and that in the setting for the transmissive-type display, the variation of the light-source light in the liquidcrystal device with respect to the variation of the gray scale level becomes relatively large.

According to this aspect, since the switching by the switch causes the variation of the transmittance of the external light with respect to the variation of the gray scale level to become relatively small in the reflective-type display mode, the contrast ratio becomes small. In contrast, in the transmissive-type display mode, since the variation of the transmittance of the external light with respect to the variation of the gray scale level becomes relatively large, the contrast ratio becomes large. Therefore, when, in particular, there is no shading film in the liquid-crystal element (see FIGS. 22 and 23), the difference in the contrast ratio between during the reflective-type display time and during the transmissive-type display time can be reduced as well, and the variation of the contrast ratio when the light source is switched on or when it is switched off can be decreased to such a degree so as not to be very conspicuous or noticeable.

In another aspect of the liquid-crystal panel driving device of the present invention, there is further provided a switching-on control device for controlling the switching-on and the non-switching-on of the light source. The switch switches the setting of the magnitude of the effective value in synchronization with the control of the switching-on and the non-switching-on by the switching-on control device.

According to this aspect, the switching-on control device controls the switching-on and the non-switching-on of the light source. Thereupon, the switch switches the setting of the magnitude of the applied voltage in synchronization with the control of the switching-on and the non-switching-on by the switching-on control device. Therefore, in response to the non-switching-on (switching off) and the switching-on of the light source, it is possible to switch between the setting for the reflective-type display and the setting for the transmissive-type display reliably and without delay.

In order to achieve the above objects, the liquid-crystal device of the present invention comprises the above-described liquid-crystal panel driving device according to the present invention and a liquid-crystal panel.

According to the liquid-crystal device of the present invention, since the liquid-crystal device comprises the above-described driving device of the present invention, it is possible to produce a display at an appropriately adjusted brightness and at a contrast ratio in both the reflective-type display mode and the transmissive-type display mode. Furthermore, the variation of the contrast ratio and the brightness when these display modes are switched is not visually conspicuous, and a congruous display which is very easy to see can be produced.

According to one aspect of the liquid-crystal device of the present invention, the liquid-crystal element comprises a plurality of data lines, disposed on a substrate, to which a data signal is supplied; a plurality of scanning lines, disposed on the substrate, to which a scanning signal is supplied; and a plurality of two-terminal-type non-linear elements which are connected in series, respectively, together with the liquid-crystal portion in each pixel between the plurality of data lines and the plurality of scanning lines.

According to this aspect, a data signal is supplied from the data line to the liquid-crystal portion in each pixel via the two-terminal-type non-linear element connected in series with the liquid-crystal portion, and a scanning signal is supplied thereto from the scanning line. Therefore, for example, by using the magnitude of the voltage value of an applied voltage based on the difference between the data-signal voltage and the scanning-signal voltage and the period of the pulse width of the data signal, a bright reflective-type display can be produced when the light source is not switched on, and when the light source is switched on, a transmissive-type display can be produced at a high contrast ratio.

In this aspect, the two-terminal-type non-linear element may comprise a TFD (Thin Film Diode) driving element.

With such a construction, in a transflective liquid-crystal panel for use with a TFD active-matrix driving method, a bright reflective-type display can be produced when the light source is not switched on, and when the light source is switched on, a transmissive-type display can be produced at a high contrast ratio.

As an applicable transflective liquid-crystal panel of the present invention, in addition to a liquid-crystal panel for use with a TFD active-matrix driving method, there are various liquid-crystal panels, such as a liquid-crystal panel for use with a TFT active-matrix driving method, or a liquid-crystal panel for use with a simple-matrix driving method. That is, when any publicly known liquid-crystal panel is employed, in the transflective liquid-crystal panel, the present invention functions effectively, and the above-described operations and effects which are characteristics of the present invention can be obtained.

In another aspect of the liquid-crystal device of the present invention, a pair of polarized-light separation devices comprise a pair of polarizers disposed in such a way that their transmission axes form a predetermined angle, the liquid-crystal panel further comprises a transflector disposed on a side opposite to the liquid-crystal element with respect to one of the pair of polarizers, and the light source causes the light-source light to enter the liquid-crystal element via the transflective film and the one polarizer.

According to this aspect, when the light source is not switched on, the external light enters the liquid-crystal element via the other (the polarizer of the display screen side) of the pair of polarizers disposed in such a way that their transmission axes form a predetermined angle (for example, 90 degrees when a TN liquid-crystal element is provided and a normally white mode is set, 0 degree when a TN liquid-crystal element is provided and a normally black mode is set, and the like), and the external light is further reflected by a transflective film via the one polarizer (the polarizer in an inner part close to the light source). Thereafter, the reflected external light is selectively output from the display screen via one polarizer, the liquid-crystal element, and the other polarizer according to the alignment state of the liquid-crystal element. Therefore, when the light source is not switched on, a reflective-type display is produced. Also, when the light source is switched on, the light-source light enters the liquid-crystal element via the transflective film and one of the polarizers, and is further selectively output from the display screen via the other polarizer according to the alignment state of the liquid-crystal element. Therefore, when the light source is switched on, a transmissive-type display is produced.

One or both of the pair of the polarized-light separation devices may be formed of a publicly known polarized-light separator, such as a reflection polarizer, other than a polarizer, such as polarization plate. For example, if the polarized-light separation device is formed of a reflection polarizer, since polarized-light separation is performed by reflection, efficiency of use of light is higher than a case in which a polarizer is used, and the brightness at a reflectivetype display is increased correspondingly. Furthermore, the construction may be formed in such a way that a reflection polarizer disposed on a region close to the light source is made to have the function of a transflective film. Furthermore, there is a case in which so-called positive-negative inversion occurs between a reflective-type display and a transmissive-type display depending upon the properties and combination of polarized-light separation devices to be employed. When positive-negative inversion opposite measure technology is performed on this inversion, the present invention functions effectively as well.

The above operations and other advantages of the present invention will become apparent from the embodiments described below.

BRIEF DESCRIPTION OF THE DRAWINGS

FIG. 1 5A is a characteristic view showing an example of a relationship between a gray scale level and transmittance in the first embodiment of the present invention.

DETAILED DESCRIPTION OF PREFERRED EMBODIMENTS

The embodiments of the present invention will now be described below with reference to the drawings.

Figure 1:
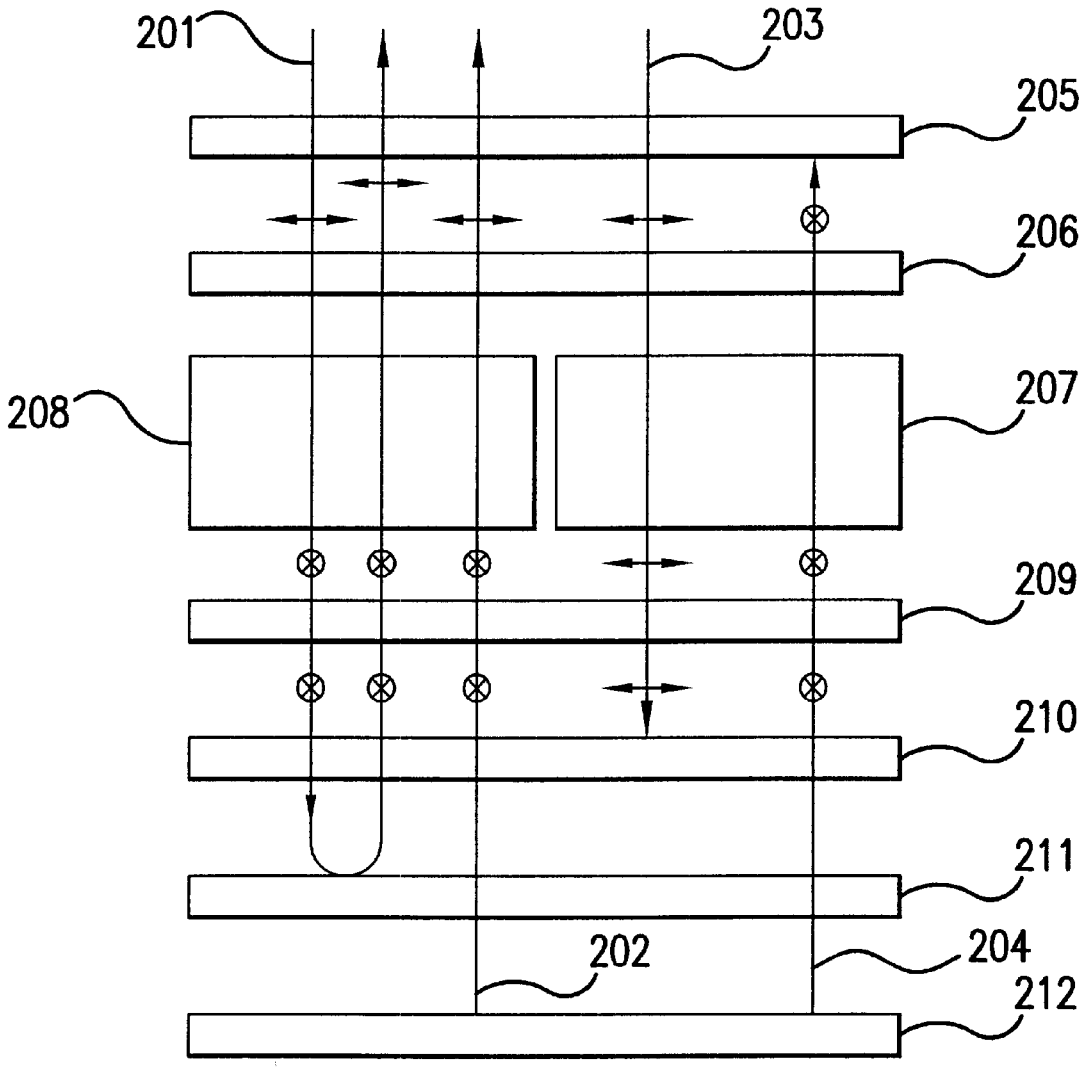
FIG. 1 is a schematic sectional view illustrating the operating principle during a reflective-type display and a transmissive-type display of a liquid-crystal panel provided in each embodiment of the present invention.
Figure 2:
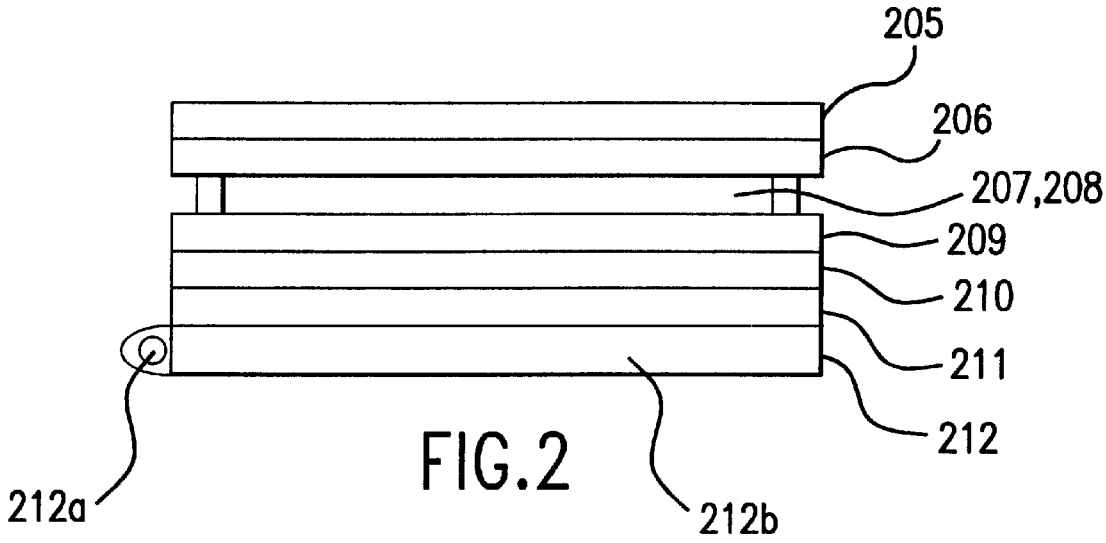
FIG. 2 is a sectional view of the liquid-crystal panel provided in each embodiment of the present invention.

First, as an example of a transflective-type liquid-crystal panel used in each embodiment of the present invention, referring to FIGS. 1 and 2, a description is given of the basic constitution in a liquid-crystal panel having a construction in which a TN liquid-crystal element is sandwiched between two polarizers, and of the principle of a reflective-type display and a transmissive-type display. FIG. 1 is a schematic sectional view of a transflective-type liquid-crystal panel. FIG. 2 is a sectional view of a transflective-type liquid-crystal panel.

Referring to FIG. 1, the liquid-crystal panel comprises an upper polarizer 205, an upper glass substrate 206, a TN liquid-crystal layer including a voltage applied area 207 and a voltage non-applied area 208, a lower glass substrate 209, a lower polarizer 210, a transflector 211, and a light source 212. As the transflector 211, for example, a thinly formed Al (aluminum) plate is used. Alternatively, by providing an opening portion in a reflection plate, the transflector 211 may be formed. It is assumed that the upper polarizer 205 and the lower polarizer 210 are disposed in such a way that their transmission polarization axes are at right angles to each other in order to produce a display in the normally white mode.

White display during a reflective-type display time is described first. Light shown in a light path 201 becomes linearly polarized light in a direction parallel to the plane of the paper through the upper polarizer 205, as a result of its polarization direction being deflected by 90° by the voltage non-applied area 208 of the TN liquid-crystal layer, becomes linearly polarized light in a direction perpendicular to the plane of the paper, and is transmitted through the lower polarizer 210 and is maintained as linearly polarized light in a direction perpendicular to the plane of the paper, and is reflected by the transflector 211 and a part thereof is transmitted. The reflected light is transmitted through the lower polarizer 210 again and is maintained as linearly polarized light perpendicular to the plane of the paper, as a result of its polarization direction being deflected by 90° by the voltage non-applied area 208 of the TN liquidcrystal layer, becomes linearly polarized light in a direction parallel to the plane of the paper, and is output from the upper polarizer 205. In a manner as described above, during the voltage non-applied time, a white display is produced. In contrast, light shown in a light path 203 becomes linearly polarized light in a direction parallel to the plane of the paper through the upper polarizer 205, is transmitted through the voltage applied area 207 of the TN liquid-crystal layer and is maintained as linearly polarized light in a direction parallel to the plane of the paper without changing its polarization direction in the voltage applied area 207, and is absorbed by the lower polarizer 210. Therefore, a black display is produced.

Next, a description is given of white and black displays during a transmissivetype display time. Part of light which is emitted from the light source 212 and which is shown in a light path 202 is transmitted through the transflector 211, becomes linearly polarized light in a direction perpendicular to the plane of the paper in the lower polarizer 210, as a result of its polarization direction being deflected by 90° by the voltage non-applied area 208 of the TN liquid-crystal layer, becomes linearly polarized light in a direction parallel to the plane of the paper, is transmitted through the upper polarizer 205 and is maintained as linearly polarized light in a direction parallel to the plane of the paper, thereby producing a white display. In contrast, part of light which is emitted from the light source 212 and which is shown in a light path 204 is transmitted through the transflector 211, becomes linearly polarized light in a direction perpendicular to the plane of the paper in the lower polarizer 210, is transmitted through the voltage applied area 207 of the TN liquid-crystal layer without changing its polarization direction, and is absorbed by the upper polarizer 205, thereby producing a black display.

In FIG. 1, for illustration of the light state at each position, the respective plates, the liquid-crystal layer, and the like, are depicted in such a manner as to be spaced apart. In practice, however, as shown in FIG. 2, these respective members are disposed so as to be in close contact with each other. Also, as shown in FIG. 2, the light source 212 comprises a light-source lamp 212*a* which emits light in the transmissive-type display mode, and a light guide plate 212*b* which guides light emitted from the light-source lamp 212*a* to the side of the transflector 211.

In FIGS. 1 and 2, since the polarizers 205 and 210, which are examples of a pair of polarized-light separation devices, performs polarized-light separation by absorbing polarization components in a direction different from a specific polarization-axis direction from among incident light beams, efficiency of use of light is relatively poor. Consequently, as a pair of polarized-light separation devices in this embodiment, in place of at least one of the two polarizers 205 and 210, a reflection polarizer may be used which performs polarized-light separation by reflecting polarization components (reflective polarizer) in a direction different from a specific polarization-axis direction from among incident light beams. With such a construction, efficiency of use of light is increased by the reflection polarizer, making possible a display brighter than the above example in which the polarizer is used. Such a reflection polarizer is disclosed in Japanese Patent Applied No. 8-245346, Japanese laid-open Patent No. 9-506985 (International Patent publication: WO/95/17692), and International Patent publication: WO/95/27819.

In addition, instead of such a polarizer and reflection polarizer, as the polarized-light separation device of the present invention, it is possible to use, for example, a combination of a cholesteric liquid-crystal layer and (1/4)λ device, a device which separates light into reflected polarized light and transmitted polarized light by using the Brewster angle (SID 92 DIGEST pp.427–429), a device using hologram, and a device disclosed in international applications (International Patent publications: W095/27819 and W095/17692).

Figure 3:
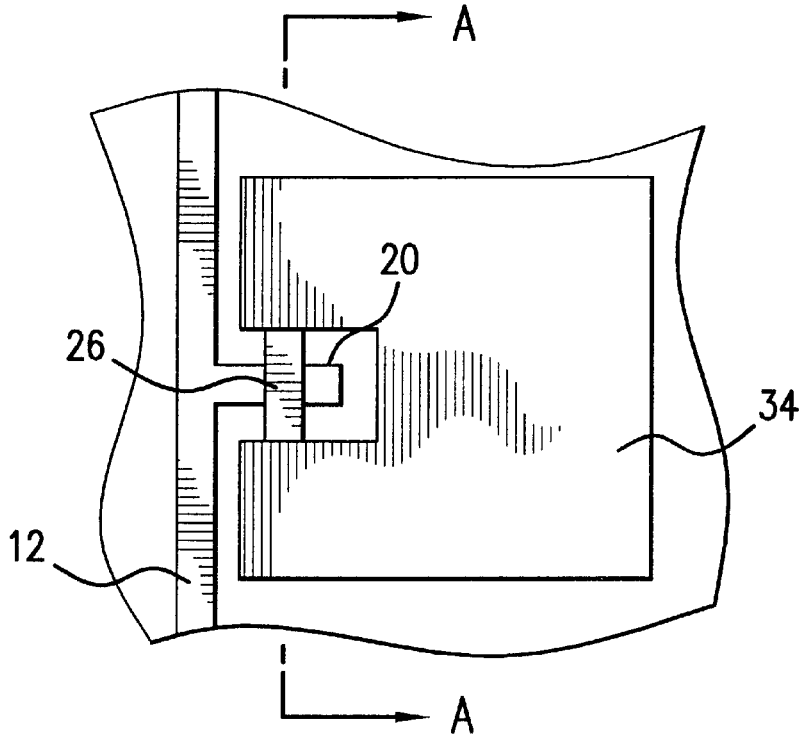
FIG. 3 is a plan view showing, together with a pixel electrode, an example of a TFD driving element provided in each embodiment of the present invention.
Figure 4:
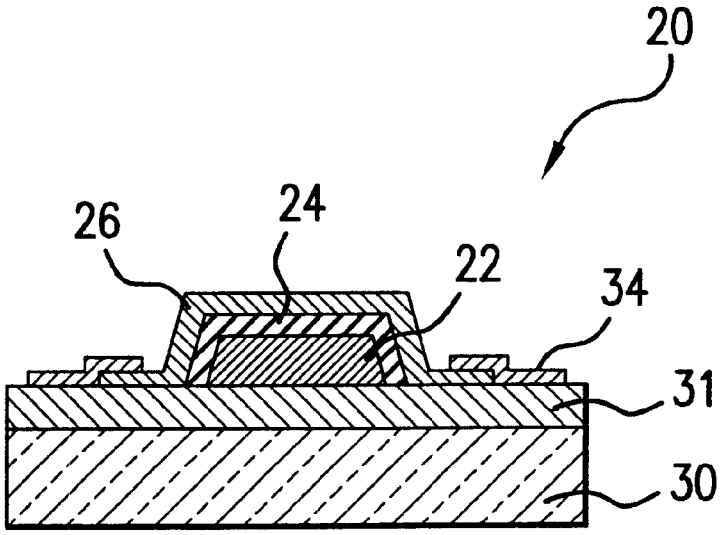
FIG. 4 is an A—A sectional view of FIG. 3.
Figure 5:
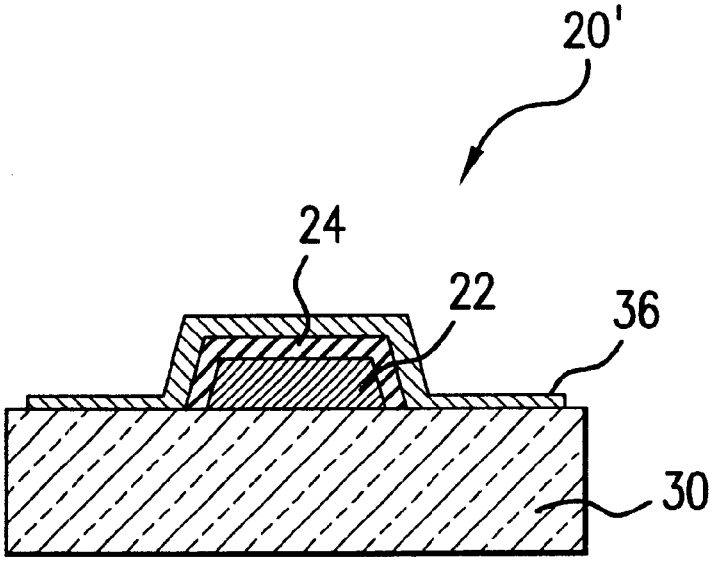
FIG. 5 is a sectional view, corresponding to the A—A sectional view of FIG. 3, showing another example of the TFD driving element provided in each embodiment of the present invention.
Figure 6:
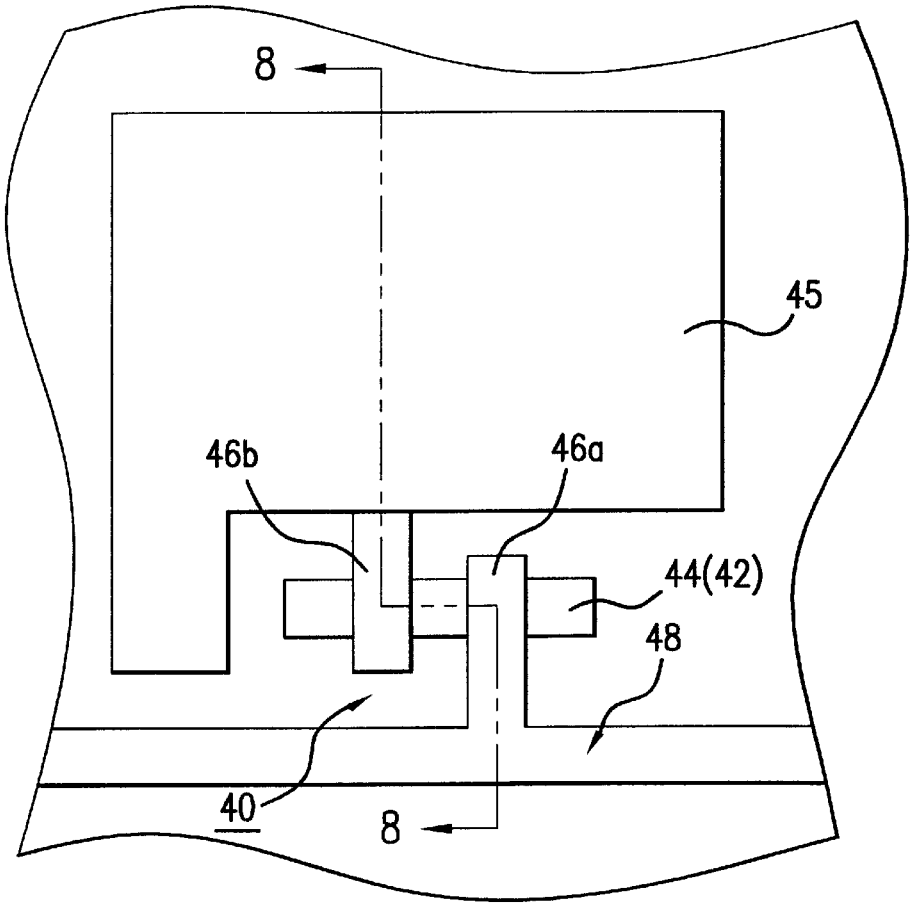
FIG. 6 is a plan view showing, together with an pixel electrode, another example of the TFD driving element provided in each embodiment of the present invention.
Figure 7:
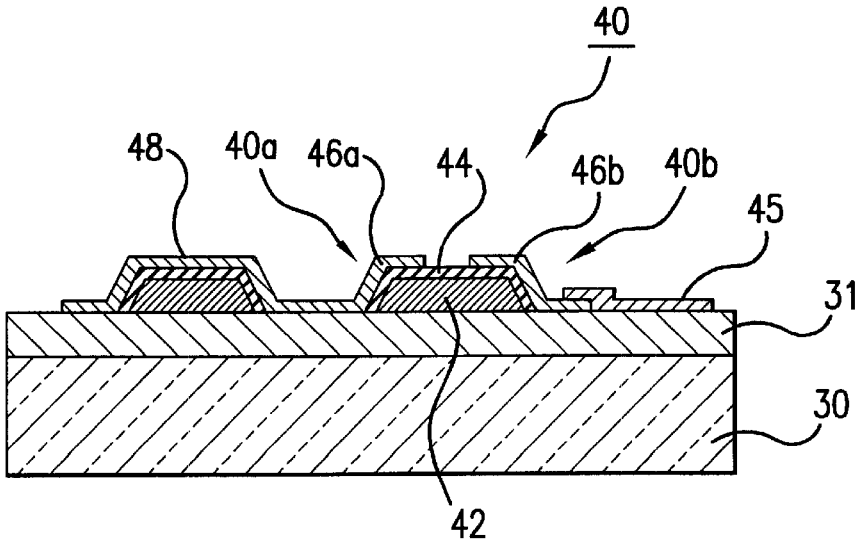
FIG. 7 is a B—B sectional view of FIG. 6.

Next, referring to FIGS. 3 to 7, a description is given of a TFD driving element as an example of a two-terminal-type non-linear element provided in a liquid-crystal element which is a constituent of a liquid-crystal panel for use with a TFD active-matrix driving method, which is an example of a transflective-type liquid-crystal panel for use in each embodiment of the present invention. Here, FIG. 3 is a plan view schematically showing a TFD driving element together with a pixel electrode. FIG. 4 is an A—A sectional view of FIG. 3. FIG. 5 is a sectional view showing a modification of a TFD driving element. FIGS. 6 and 7 are a plan view and a sectional view, respectively, showing another modification of the TFD driving element. In FIGS. 4, 5, and 7, in order that each layer and each member be drawn sufficiently large to be visible in the drawings, the scale is different for each layer and for each member.

Referring to FIGS. 3 and 4, a TFD driving element 20 is formed on an insulation film 31 formed on the TFD array substrate 30 with the insulation film 31 being a base. The TFD driving element 20 is formed of a first metal film 22, an insulation layer 24, and a second metal film 26 in sequence from the side of the insulation film 31, and has a TFD (Thin Film Diode) structure or a MIM (Metal Insulator Metal) structure. The first metal film 22 of the two-terminal-type TFD driving element 20, as one of the terminals, is connected to a scanning line 12 formed on the TFD array substrate 30, and the second metal film 26, as the other terminal, is connected to a pixel electrode 34. In place of the scanning line 12, a data line (see FIG. 8) may be formed on the TFD array substrate 30 and connected to the pixel electrode 34.

The TFD array substrate 30 is formed from a substrate having insulation properties and transparency, such as glass, plastic, or the like.

The insulation film 31 which becomes the base is formed from, for example, tantalum oxide. The insulation film 31, however, is formed for the main purpose of preventing the first metal film 22 from being peeled off from the base and preventing impurities from being diffused into the first metal film 22 as a result of heat treatment performed after the second metal film 26 is deposited. Therefore, when such peeling off and diffusion of impurities are not problems because the TFD array substrate 30 is formed of a substrate, such as a quartz substrate, having excellent resistance to heat and excellent purity, the insulation film 31 may be omitted.

The first metal film 22 is formed from a conductive metal thin-film, and is formed from, for example, tantalum or a tantalum alloy. Alternatively, with a tantalum or a tantalum alloy being main ingredients, for example, elements belonging to the VI, VII, or VIII group in the periodic table, such as tungsten, chromium, molybdenum, rhenium, yttrium, lanthanum, or dysprosium, may be applied thereto. In this case, as an element to be added, tungsten is preferable, and the content ratio thereof is preferably, for example, 0.1 to 6 atom %.

The insulation layer 24 is formed, for example, from an oxide film formed on the surface of the first metal film 22 by anode oxidation in a chemical liquid.

The second metal film 26 is formed from a conductive metal thin-film, and is formed, for example, from chromium or a chromium alloy.

The pixel electrode 34 is formed, for example, from a transparent conductive film, such as ITO (Indium Tin Oxide).

Furthermore, as shown in the sectional view of FIG. 5, the above-mentioned second metal film and pixel electrode may be formed from a transparent conductive film 36 made of the same ITO film or the like. A TFD driving element 20' having such a constitution has the advantage that the second metal film and the pixel electrode can be formed by the same manufacturing steps. Components in FIG. 5 which are the same as those of FIG. 4 are given the same reference numerals, and accordingly, descriptions thereof have been omitted.

In addition, as shown in the plan view of FIG. 6 and the B—B sectional view of FIG. 7, a TFD driving element 40 may be formed so as to have a so-called "back-toback" structure, that is, a structure in which a first TFD driving element 40*a* and a second TFD driving element 40*b* are connected in series with their polarities reversed. Components in FIGS. 6 and 7 which are the same as those of FIGS. 3 and 4 are given the same reference numerals, and accordingly, descriptions thereof have been omitted.

Referring to FIGS. 6 and 7, the first TFD driving element 40*a* is formed from a first metal film 42 made of tantalum or the like, an insulation layer 44 made of an anode oxide film or the like, and a second metal film 46*a* made of chromium or the like, which are formed in this order on the insulation film 31 formed on the TFD array substrate 30 with the insulation film 31 being a base. In contrast, the second TFD driving element 40*b* is formed from a first metal film 42, an insulation layer 44, and a second metal film 46*b* spaced apart from the second metal film 46*a* in this order on the insulation film 31 formed on the TFD array substrate 30 with the insulation film 31 being a base.

The second metal film 46*a* of the first TFD driving element 40*a* is connected to a scanning line 48, and the second metal film 46*b* of the second TFD driving element 40*b* is connected to a pixel electrode 45 formed from an ITO film or the like. Therefore, the scanning signal is supplied from the scanning line 48 to the pixel electrode 45 via the first and second TFD driving elements 40*a* and 40*b*. In place of the scanning line 48, a data line (see FIG. 8) may be formed on the TFD array substrate 30 and connected to the second metal film 46*a* of the first TFD driving element 40*a*.

In the example shown in FIGS. 6 and 7, the insulation layer 44 has a film thickness smaller than that of the insulation layer 24 in the example shown in FIGS. 4 and 5, and is set to, for example, a film thickness of about one-half.

In the foregoing, several examples of a TFD driving element as a two-terminal-type non-linear element have been described. In addition, a two-terminal-type non-linear element having both-directional diode characteristics, such as a ZnO (Zinc Oxide) varister, a MSI (Metal Semi-Insulator) driving element, or a RD (Ring Diode), may be used in a liquid-crystal panel for use with an active-matrix driving method of this embodiment.

Figure 8:
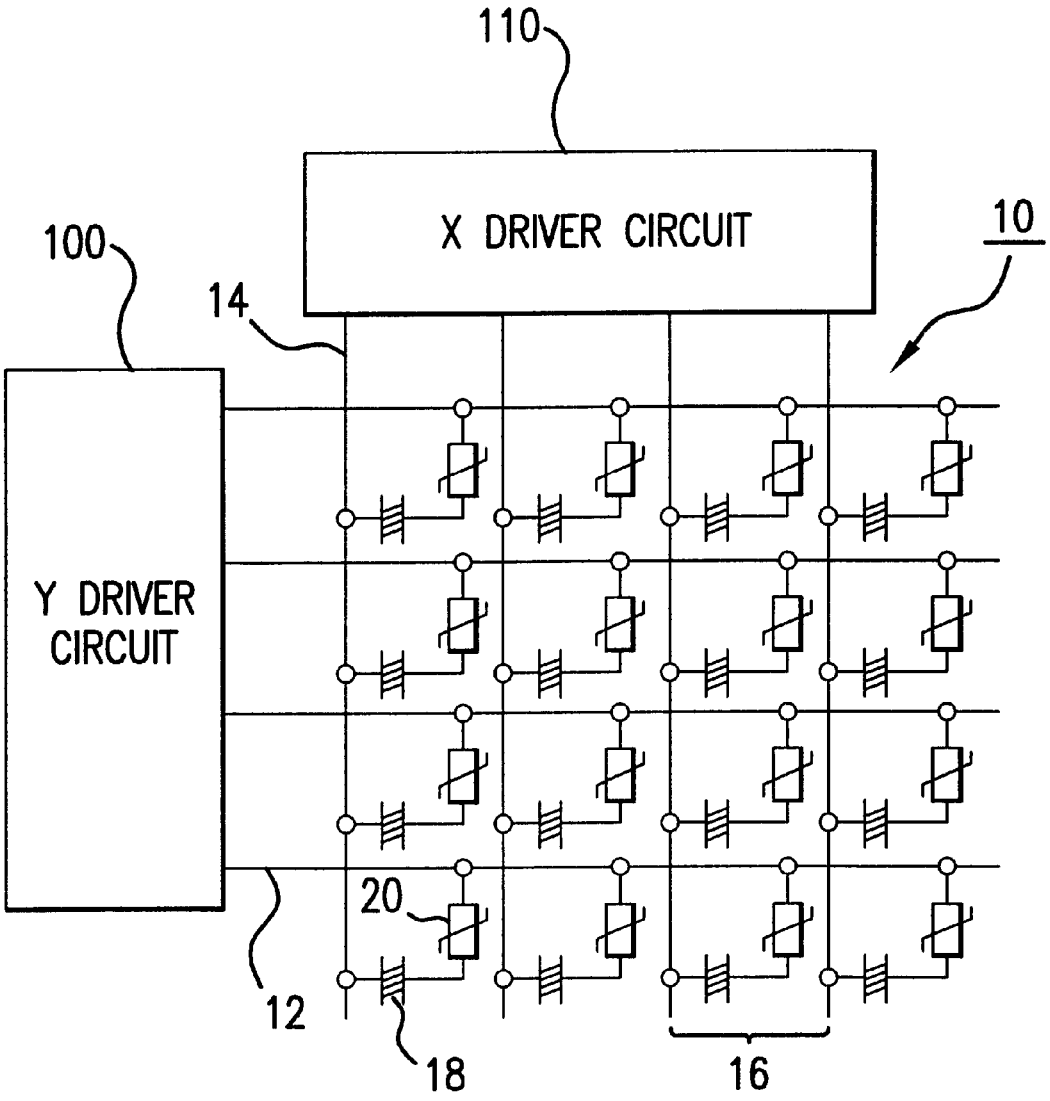
FIG. 8 is an equivalent circuit diagram showing a circuit which is a constituent of the liquid-crystal panel and a driver circuit in the embodiment of the present invention.
Figure 9:
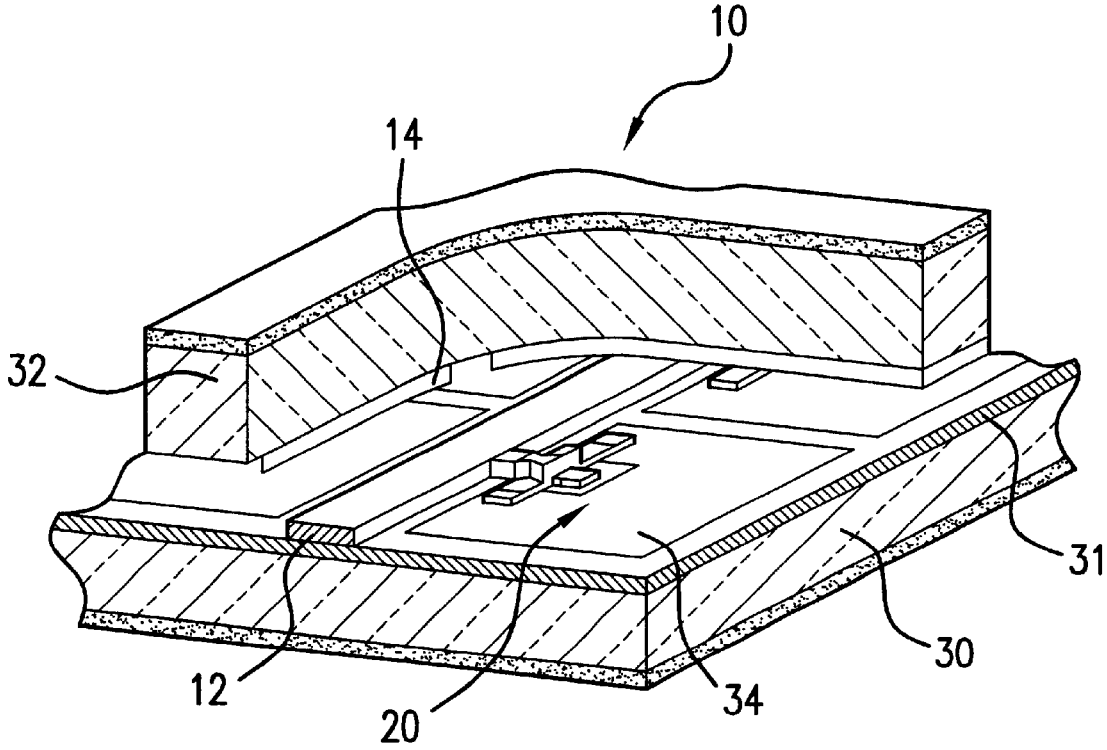
FIG. 9 is a partially exploded perspective view schematically showing the liquid-crystal panel in the embodiment of the present invention.

Next, referring to FIGS. 8 and 9, a description is given of the construction and operation of a liquid-crystal element comprising a TFD driving element constructed in a manner as described above. Here, FIG. 8 is an equivalent circuit diagram in which a liquid-crystal element is shown together with a driving circuit. FIG. 9 is a partially exploded perspective view schematically showing the liquid-crystal element.

Referring to FIG. 8, in a liquid-crystal element 10, a plurality of scanning lines 12 disposed on the TFD array substrate 30 or on a opposite substrate are connected to a Y driver circuit 100 which forms an example of a scanning-signal supply device, and a plurality of data lines 14 disposed on the TFD array substrate 30 or on the opposite substrate are connected to an X driver circuit 110 which forms an example of a data-signal supply device. The Y driver circuit 100 and the X driver circuit 110 may be formed on the TFD array substrate 30, shown in FIG. 3 and 4, or on the opposite substrate, and in this case, becomes a liquid-crystal panel including a driving circuit. Alternatively, the Y driver circuit 100 and the X driver circuit 110 may be formed of ICs independently of the liquid-crystal panel, and may be connected to the scanning lines 12 and the data lines 14 through a predetermined wiring and in this case, becomes a liquid-crystal panel not including a driving circuit.

In each pixel area 16, the scanning line 12 is connected to one of the terminals of the TFD driving element 20 (see FIG. 3), and the data line 14 is connected to the other terminal of the TFD driving element 20 via a liquid-crystal layer 18 and the pixel electrode 34 shown in FIG. 3. Therefore, when a scanning signal is supplied to the scanning line 12 corresponding to each pixel area 16 and a data signal is supplied to the data line 14, the TFD driving element 20 in the corresponding pixel area is turned on, thereby causing a driving voltage to be applied to the liquid-crystal layer 18 between the pixel electrode 34 and the data line 14 via the TFD driving element 20.

The provision of the Y driver circuit 100 and the X driver circuit 110 on the TFD array substrate 30 has the advantage that a thin-film formation process for the TFD driving element 20 and a thin-film formation process for the Y driver circuit 100 and the X driver circuit 110 can be performed at the same time. However, the manufacturing of the liquid-crystal element 10 becomes easier if a construction is employed in which the scanning lines 12 and the data lines 14 are connected to an LSI including the Y driver circuit 100 and the X driver circuit 110 mounted by a TAB (tape automated bonding) method via an anisotropic conductive film provided in the peripheral portion of the TFD array substrate 30. A construction can also be employed in which the above-mentioned LSI is connected to the scanning lines 12 and the data lines 14 by using a COG (chip on glass) method for directly mounting the LSI on the TFD array substrate 30 and on the opposite substrate via an anisotropic conductive film.

Referring to FIG. 9, the liquid-crystal element 10 comprises the TFD array substrate 30 and an opposite substrate 32 which forms an example of a second transparent substrate disposed in such a manner as to face the TFD array substrate 30. The opposite substrate 32 is formed from, for example, a glass substrate. The TFD array substrate 30 is provided with a plurality of transparent pixel electrodes 34 in a matrix form. The plurality of pixel electrodes 34 extend respectively along a predetermined X direction and are connected to the plurality of scanning lines 12 arranged in the Y direction at right angles to the X direction, respectively. The side of the pixel electrode 34, the TFD driving element 20, the scanning lines 12, and the like, which side faces the liquid crystal, is provided with an alignment film, formed from an organic thin-film, such as a polyimide thin-film, on which a predetermined alignment process, such as a rubbing process, is performed.

In contrast, the opposite substrate 32 is provided with a plurality of data lines 14 which extend respectively along the Y direction and which are disposed in rectangles along the X direction. An alignment film, formed from an organic thin film, such as a polyimide thin-film, on which a predetermined alignment process, such as a rubbing process, is performed is provided below the data line 14. In this case, the data line 14 is formed from a transparent conductive film, such as an ITO film, in a portion at least opposite the pixel electrode 34. When, however, the scanning line 12, instead of the data line 14, is formed on the side of the opposite substrate 32, the scanning line 12 is formed from a transparent conductive film, such as an ITO film.

Figure 20:
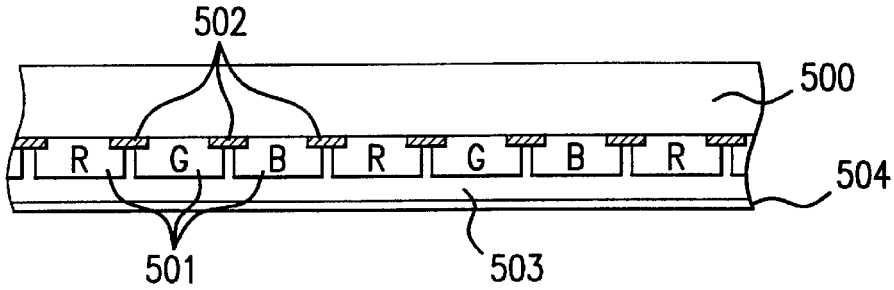
FIG. 20 is a sectional view of an opposite substrate in a liquid-crystal element in which color filters and a shading film which separates each pixel are formed.
Figure 21A:
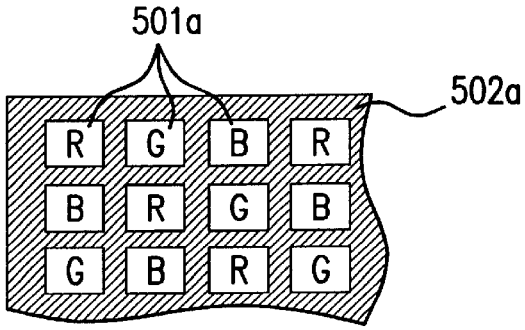
FIGS. 21A, 21B, and 21C are plan views of an opposite substrate in a liquid-crystal element in which color filters and a shading film which separates each pixel are formed, and pixels are formed in the delta arrangement, in the mosaic arrangement, and in the stripe arrangement, respectively.
Figure 21B:
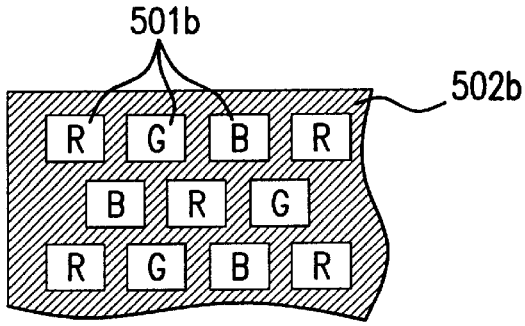
Figure 21C:
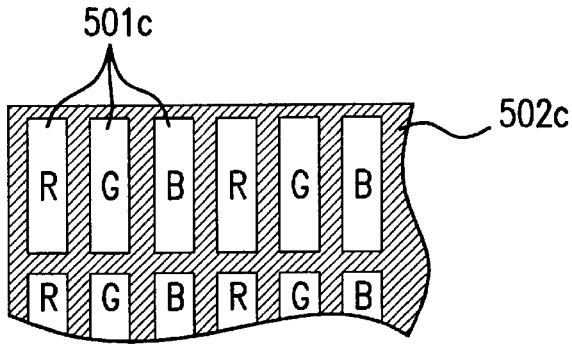
Figure 22:
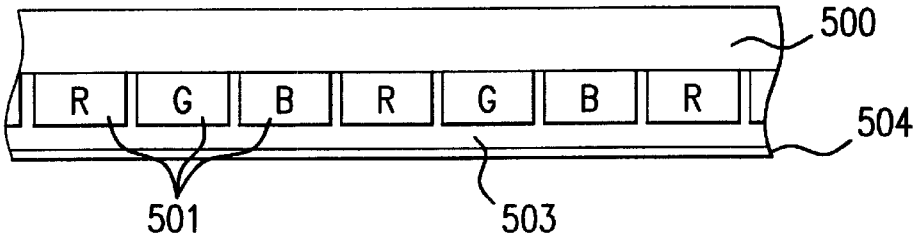
FIG. 22 is a sectional view of an opposite substrate in a liquid-crystal element in which color filters are formed and a shading film which separates each pixel is not formed.
Figure 23A:
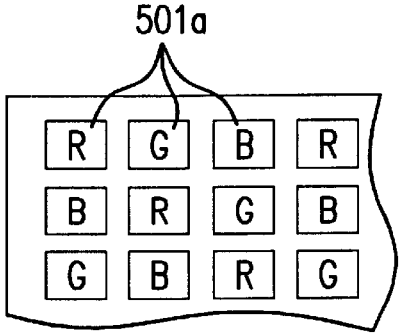
FIGS. 23A, 23B, and 23C are plan views of an opposite substrate in a liquid-crystal element in which color filters are formed and a shading film which separates each pixel is not formed, and in which pixels are formed in the delta arrangement, in the mosaic arrangement, and in the stripe arrangement, respectively.
Figure 23B:
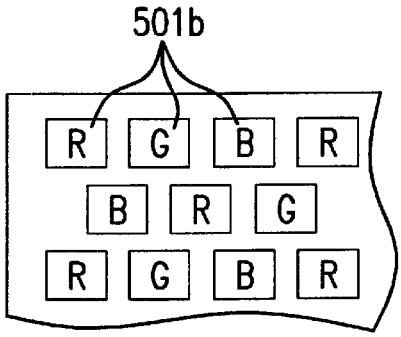
Figure 23C:
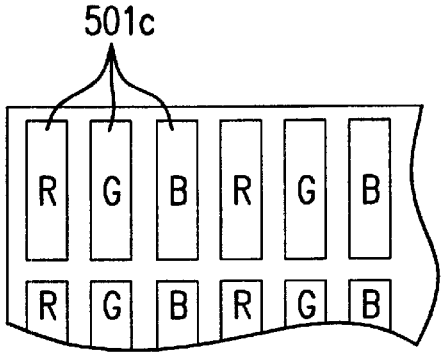

In the case of the liquid-crystal element in this embodiment, depending upon the use of the liquid-crystal element 10, the opposite substrate 32 may be provided with a color filter formed from a coloring-material film arranged in a stripe shape, a mosaic shape, a triangular shape, and so on, such as that shown in FIGS. 22 and 23. Furthermore, the opposite substrate 32 may be provided with a shading film, such as a metal material selected from chromium, nickel and so on, as shown in FIGS. 20 and 21, and as resin black, in which carbon or titanium is dispersed into photoresist. Such a color filter and shading film make a color display by one liquid-crystal panel possible, and improvement in contrast and prevention of mixing of colors of coloring materials make it possible to display a high-quality image. In this embodiment, in particular, the driving method to be described later, which is characteristic of the present invention, makes it possible to obtain an appropriate contrast ratio and brightness in the reflective-type display and the transmissive-type display regardless of whether or not there is a shading film.

Referring again to FIGS. 8 and 9, between the TFD array substrate 30 and the opposite substrate 32 constructed as described above and disposed in such a way that the pixel electrode 34 and the data line 14 face each other, a liquid crystal is sealed in a space surrounded by a sealing agent disposed around the peripheral portion of the opposite substrate 32, forming the liquid-crystal layer 18 (see FIG. 8). The liquid-crystal layer 18 takes a predetermined alignment state by the above-mentioned alignment film in a state in which the electric field from the pixel electrode 34 and the data line 14 is not applied. The liquid-crystal layer 18 is formed from a liquid crystal in which, for example, one or several types of nematic liquid crystals are mixed. The sealing agent is a bonding agent for bonding both the substrates 30 and 32 in their peripheral portions, and a spacer for making the distance between the two substrates be a predetermined value is mixed therein.

In the liquid-crystal element 10, in order to inhibit alignment failure of the liquid-crystal molecules on the side of the TFD array substrate 30, a planarization film may be coated by spin-coating or the like on the entire surface of the pixel electrode 34, the TFD driving element 20, the scanning line 12, and the like, or a CMP process may be performed thereon. Furthermore, although in the liquid-crystal element 10 of the above-described embodiment, as an example, the liquid-crystal layer 18 is formed from a nematic liquid crystal, if a polymeric-dispersed-type liquid crystal in which a liquid crystal is dispersed as fine particles into a high polymer is used, the above-mentioned alignment film, a polarization film, or a polarizer become unnecessary, and advantages of higher luminance and reduced power consumption of the liquid-crystal panel due to the increased efficiency of use of light can be obtained. In addition, by forming the pixel electrode 34 from a metal film, such as Al, having a high reflectance, when the liquid-crystal element 10 is used in a reflective-type liquid-crystal device, a SH (superhomeotropic)-type liquid crystal in which liquid-crystal molecules are oriented nearly vertically in a voltage non-applied state may be used. In addition, although in the liquid-crystal element 10, the data lines 14 is provided on the side of the opposite substrate 32 so as to apply an electric field (longitudinal electric field) perpendicular to the liquid-crystal layer, the pixel electrodes 34 may be respectively formed from a pair of electrodes for generating a horizontal electric field so as to apply an electric field (horizontal electric field) to the liquid-crystal layer (that is, on the side of the opposite substrate 32, an electrode for generating a longitudinal electric field is not provided, and an electrode for generating a horizontal electric field is provided on the side of the TFD array substrate 30). Use of a horizontal electric field in this manner is advantageous in increasing the viewing angle more than in a case in which a longitudinal electric field is used. In addition, microlenses may be formed on the opposite substrate 32 in such a manner as to have a one-to-one correspondence with the pixels. As a result of the above, by improving the efficiency of collecting incident light, a bright liquid-crystal device can be realized. In addition to this, this embodiment can be applied to various liquid-crystal materials (liquid-crystal layers), operation modes, the liquid-crystal alignments, driving methods, and the like.

Next, the operation of the liquid-crystal element constructed as described above is described with reference to FIG. 8.

Referring to FIG. 8, in synchronization with the sending in a line-sequential fashion of a pulse-shaped scanning signal having a predetermined waveform to be described later to the TFD driving element 20 by the Y driver circuit 100, the X driver circuit 110 simultaneously sends to the plurality of data lines 14 a data signal formed of pulses, whose quantity of electricity varies, defined by the pulse width and the crest value according to the gray scale level indicated by the gray scale data, as will be described later. When a voltage is applied to the pixel electrode 34 and the data line 14 in this manner, the alignment state of the liquid-crystal layer 18 in the portion sandwiched between the pixel electrode 34 and the data line 14 varies in response to an applied voltage applied via the TFD driving element 20 which has been turned on.

Then, in response to the variation of the alignment state of the liquid-crystal layer 18, the transmittance with respect to the external light or the light-source light in the transflective-type liquid-crystal panel shown in FIGS. 1 and 2 comprising the liquid-crystal element 10 varies. As a result, the degree at which the external light or the light-source light transmits through the liquid-crystal panel portion in each pixel varies according to the gray scale level, and as a whole, display light corresponding to the gray scale data is output from the liquid-crystal element 10. That is, an image in accordance with gray scale data (display data) is formed on the display screen according to the reflective-type display or the transmissive-type display.

Figure 10:
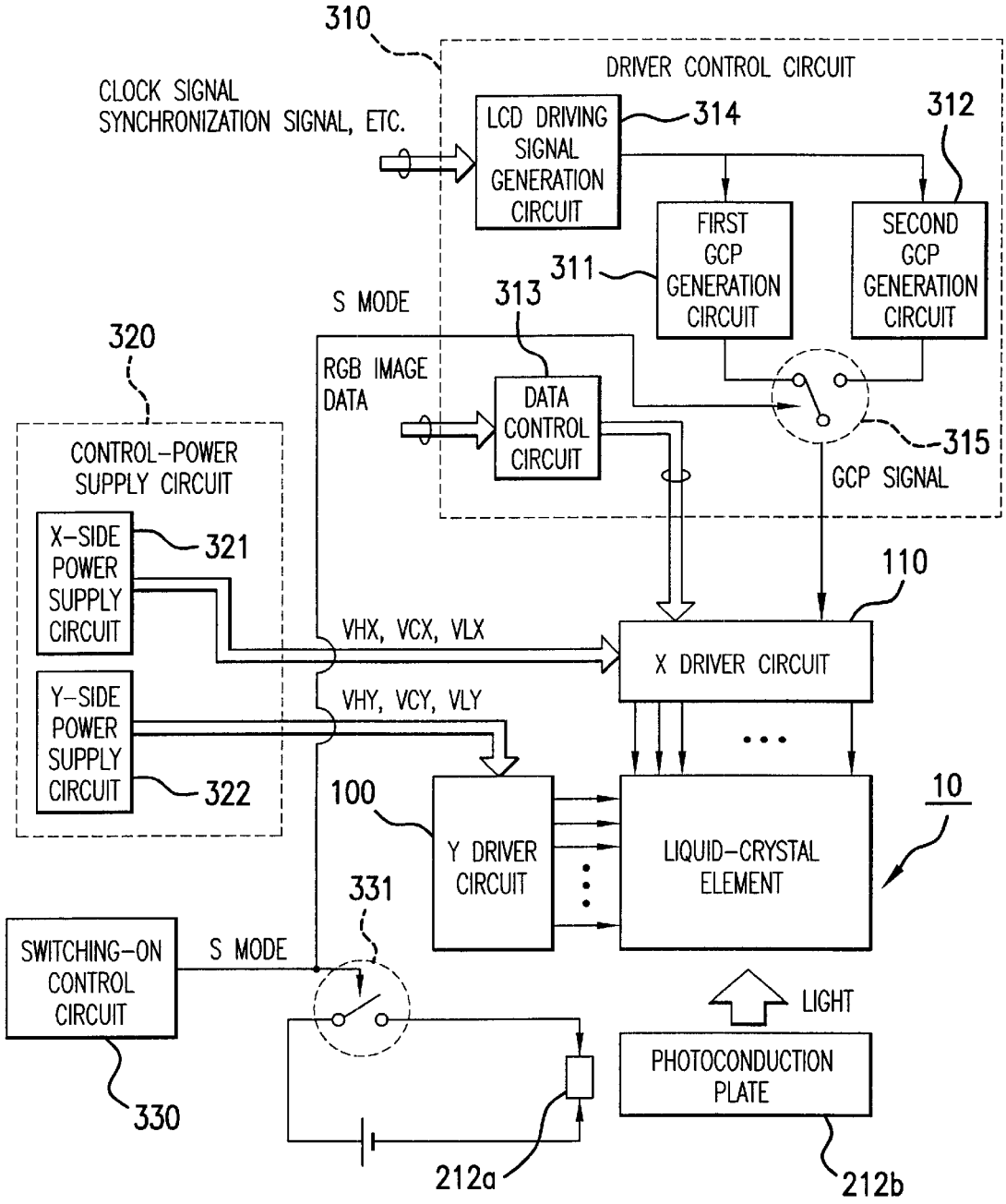
FIG. 10 is a block diagram of a liquid-crystal device comprising a liquid-crystal panel and a driving device in a first embodiment of the present invention.
Figure 11:
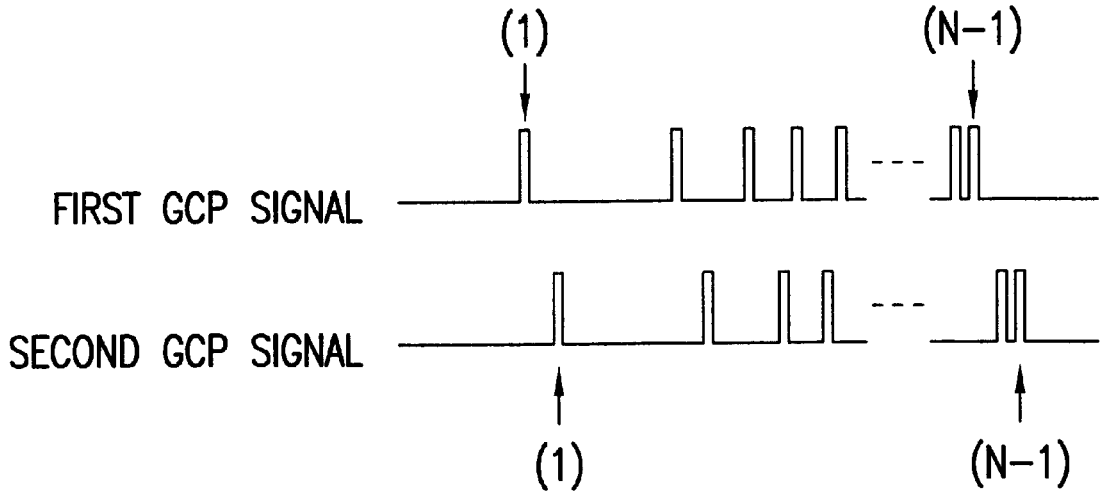
FIG. 11 is a waveform chart of first and second GCP signals generated in the first embodiment of the present invention.
Figure 12:
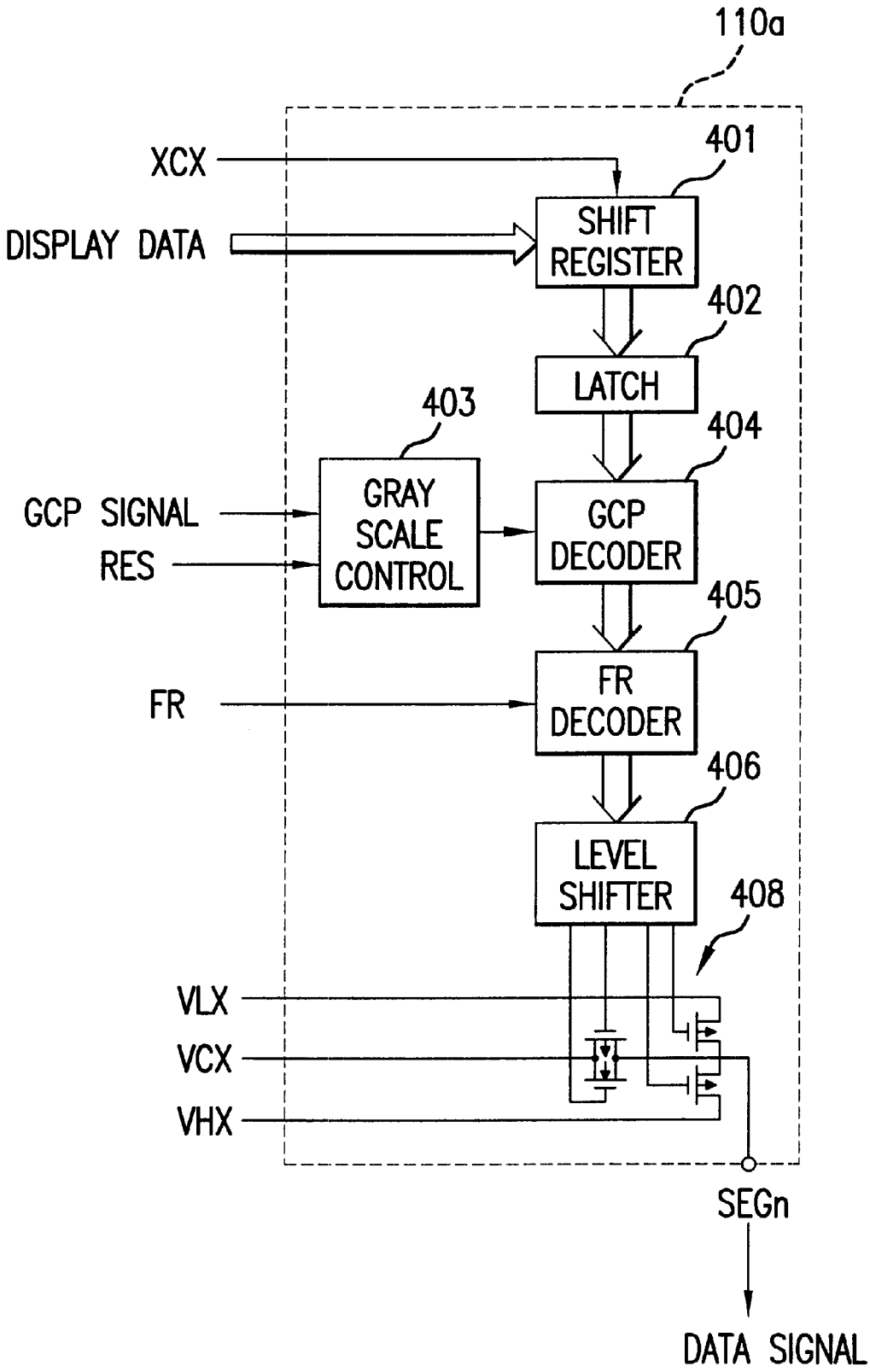
FIG. 12 is a block diagram of a portion of an X driver circuit included in the driving device provided in the first embodiment of the present invention.
Figure 13:
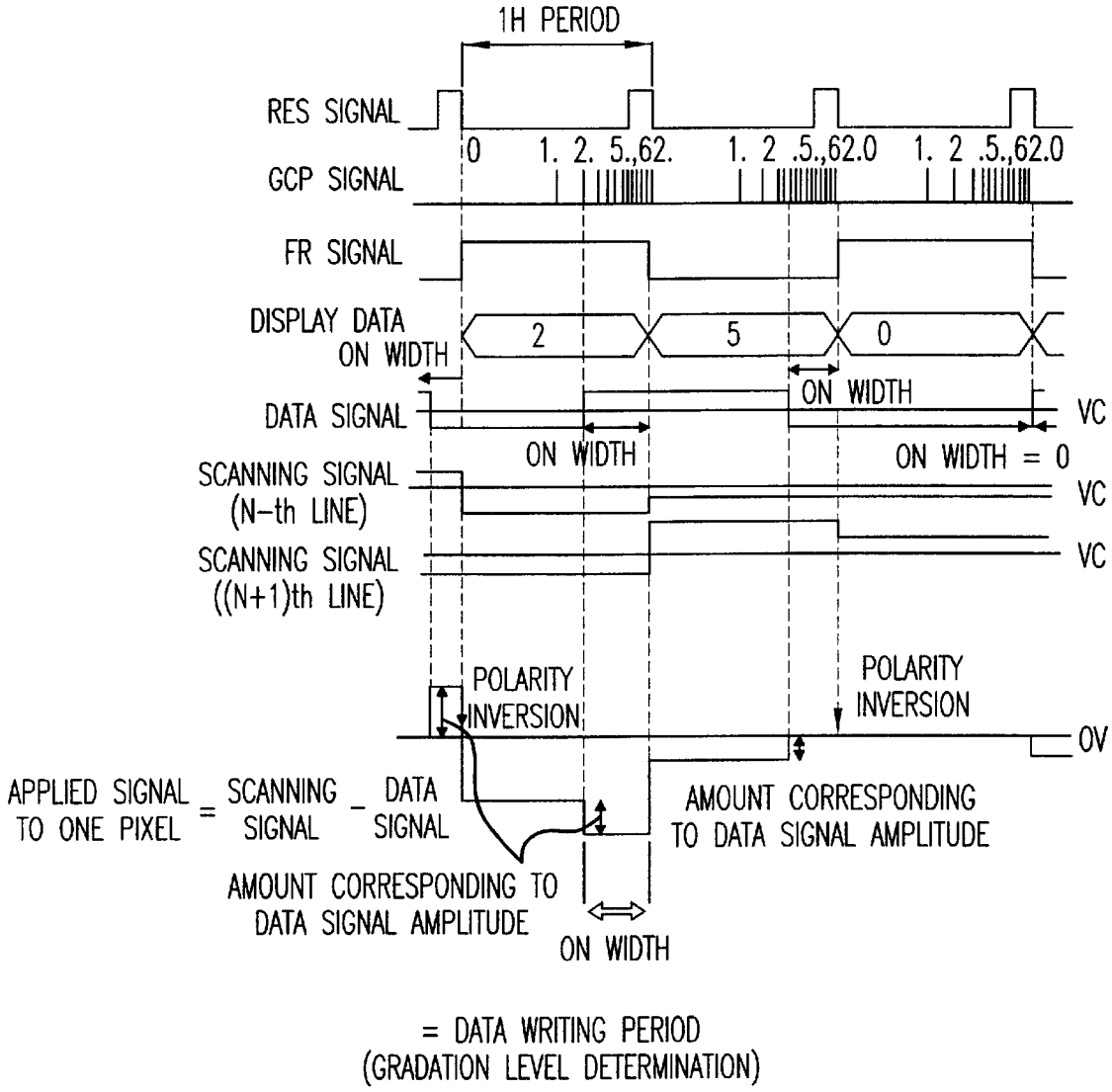
FIG. 13 is a timing chart showing the operation of the driving device provided in the first embodiment of the present invention.
Figure 14:
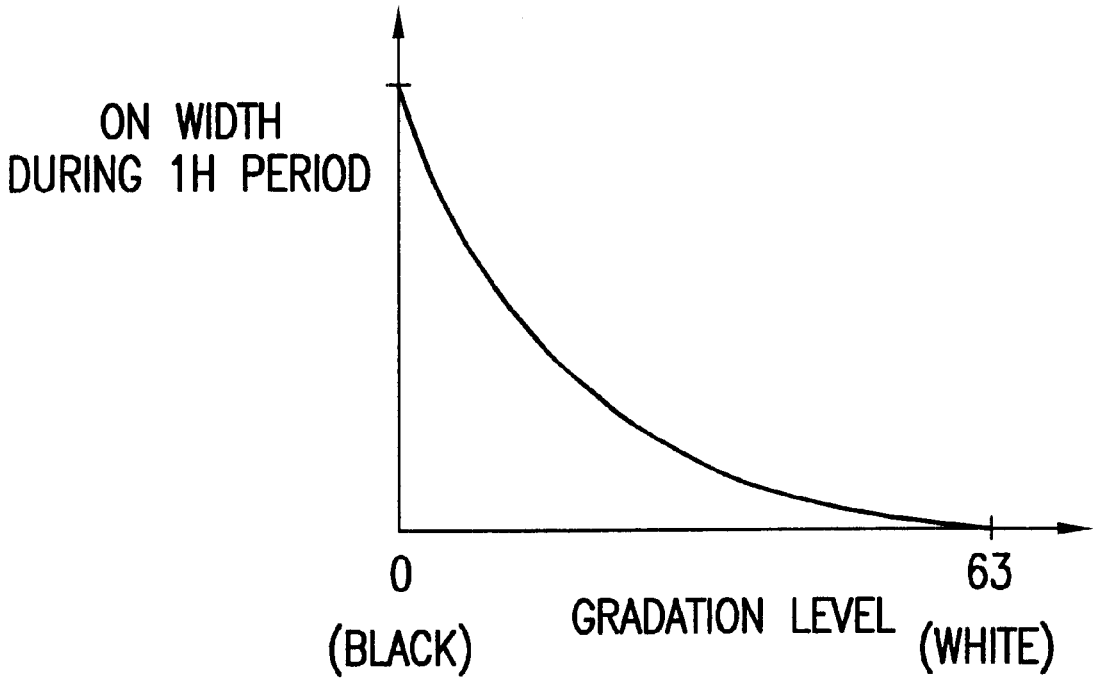
FIG. 14 is a characteristic view showing a variation of an ON width of a pulse for driving a data signal during a 1 H period with respect to a gray scale level in the first embodiment of the present invention.
Figure 15A:
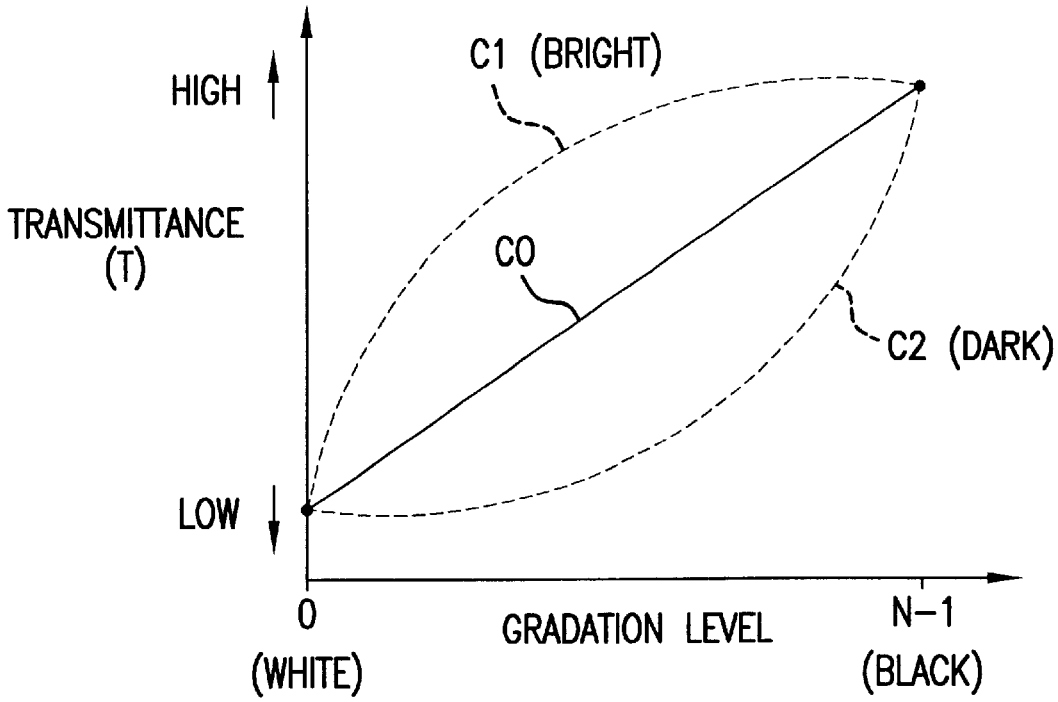
FIG. 15B is a characteristic view showing another example thereof.
Figure 15B:
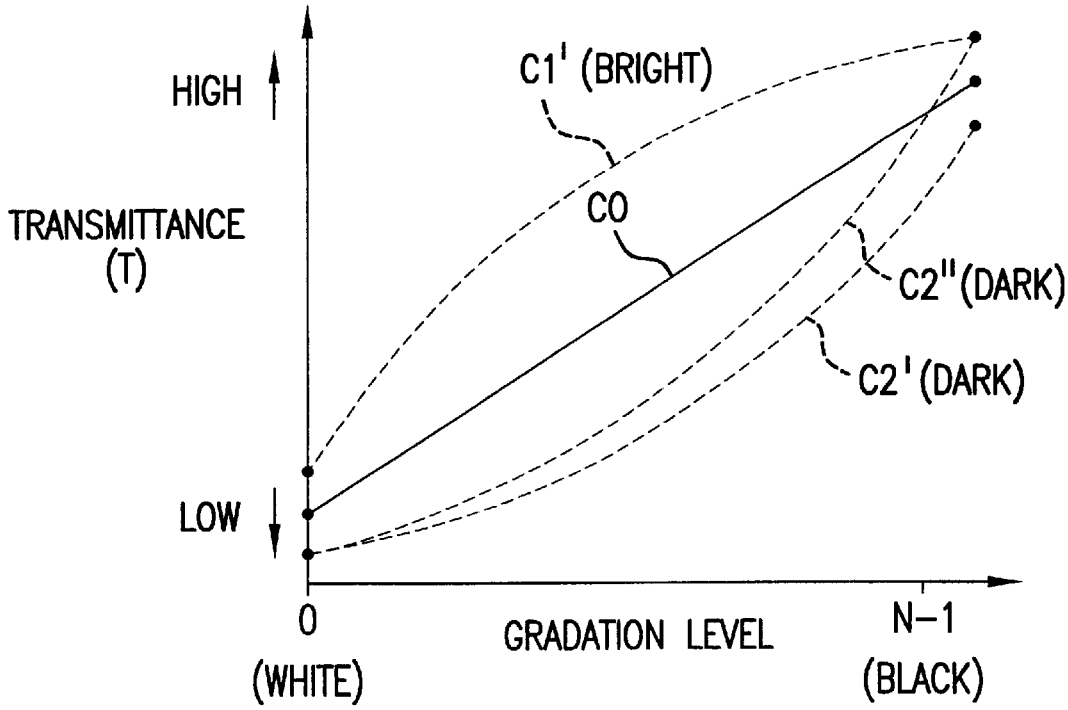
Figure 16:
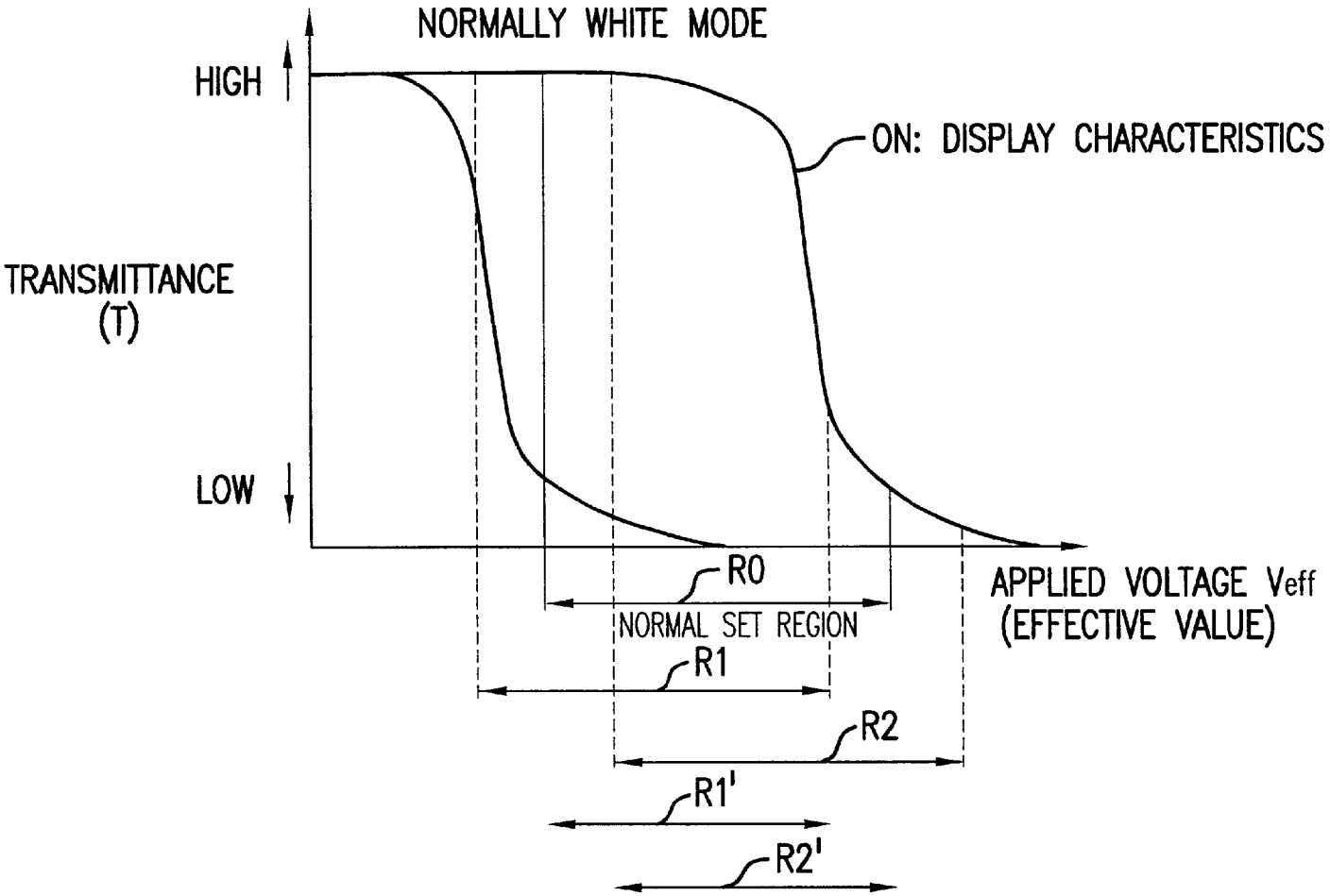
FIG. 16 is a characteristic view showing a variation of transmittance with respect to an applied voltage (effective value) in each embodiment of the present invention.

Next, referring to FIGS. 10 to 16, a description is given of the construction and the operation in a first embodiment of a driving device for driving the above-described transflective-type liquid-crystal panel including the Y driver circuit 100 and the X driver circuit 110 shown in FIG. 8. FIG. 10 is a block diagram specifically showing the construction of the driving device. FIG. 11 is a waveform chart of a first GCP signal and a second GCP signal. FIG. 12 is a block diagram of a portion where one data line in the X driver circuit is driven. FIG. 13 is a timing chart showing waveforms of various signals and a time-related relationship in the driving device. FIG. 14 is a characteristic view showing variations of an ON width of an applied signal pulse to one pixel during a 1 H period with respect to each gray scale level. FIGS. 15A and 15B are each a variation characteristic view of transmittance (T) with respect to the gray scale level. FIG. 16 is a variation characteristic view of transmittance (T) with respect to the effective value (Veff) of an applied voltage applied to a liquid crystal in the normally white mode.

As shown in FIG. 10, the driving device comprises a Y driver circuit 100 and an X driver circuit 110 which are respectively an example of a scanning-signal supply device and a data-signal supply device for supplying to the liquid-crystal element 10 an applied voltage having an effective value of a magnitude corresponding to the gray scale level indicated by the gray scale data (display data). The driving device further comprises a driver control circuit 310 which forms an example of a switch which switches the setting for each magnitude of the effective value of the applied voltage with respect to each gray scale level to a setting for a reflective-type display in response to the non-switching on of a light-source lamp 212*a* and which switches to a setting for a transmissive-type display in response to the switching on of the light-source lamp 212*a,* by switching the setting of each pulse width of a data signal with respect to each gray scale level in the X driver circuit 110, a control-power supply circuit 320 for supplying a predetermined control voltage of a high potential, a low potential, and a reference potential to the Y driver circuit 100 and the X driver circuit 110, and a switching-on control circuit 330 for controlling the switching on and the non-switching-on (switching off) of a light-source lamp 212*a.*

The driver control circuit 310 comprises a first GCP (grayscale control pulse) generation circuit 311 and a second GCP generation circuit 312 for generating a first GCP signal and a second GCP signal, respectively, which are bases for pulse width modulation when a data signal of a pulse width corresponding to the gray scale level is generated in the X driver circuit 110 as will be described later, a data control circuit 313 for converting input RGB gray scale data into a data signal of a predetermined format and outputting it into the X driver circuit 110, and an LCD-driving-signal generation circuit 314 to which various control signals, such as an X clock signal, a vertical synchronization signal, or a horizontal synchronization signal, a timing signal, and so on, are input and which generates an LCD driving signal for controlling the generation timing of the first and second GCP signals in the first and second GCP generation circuits 311 and 312.

The first GCP generation circuit 311 constitutes an example of the first pulse generator and generates a first GCP signal which is an example of a first gray scale control pulse signal formed of a plurality of pulses arranged in correspondence with the intervals of the gray scale level, which is a reference for the setting of the abovementioned pulse width for the reflective-type display.

The second GCP generation circuit 312 constitutes an example of the second pulse generator and generates a second GCP signal which is an example of a second gray scale control pulse signal formed of a plurality of pulses arranged in correspondence with the intervals of the gray scale level, which is a reference for the setting of the above-mentioned pulse width for the transmissive-type display.

As shown in FIG. 11, the first and second GCP signals have a pulse arrangement different from each other, and the pulse width with respect to the same gray scale data differs between the data signal supplied from the X driver circuit 110 in accordance with the first GCP signal and the data signal supplied from the X driver circuit 110 in accordance with the second GCP signal. In the case of gray scale data of N gray scales, the first and second GCP signals are each formed of a total of N−2 pulses from a pulse corresponding to the pulse width of the data signal for displaying a gray scale level (1) to a pulse corresponding to the pulse width of the data signal for displaying a gray scale level (N−1), and the pulses are arranged in such a way that the pulse intervals correspond to the intervals of the gray scale level.

Such first and second GCP generation circuits 311 and 312 each comprise, for example, a plurality of comparison circuits and an OR circuit for computing the OR of the comparison results thereof. These comparison circuits compare the voltage value of the LCD driving signal with a plurality of voltage values which are set in advance for the reflective-type display or for the transmissive-type display on the basis of the variation width of the pulse width with respect to the intervals of each gray scale level. Then, the OR of the comparison results of these comparison circuits is computed to generate, as the computation output, the first and second GCP signals such as those shown in FIG. 11, formed of a train of N−2 pulses per selection period, whose intervals differ in correspondence with the variation width of the pulse width corresponding to the intervals of each gray scale level.

Referring again to FIG. 10, the driver control circuit 310 further comprises a pulse signal switch 315 for selectively supplying one of such first and second GCP signals to the X driver circuit 110. The pulse signal switch 315 is switched so that the first GCP signal is supplied in synchronization with the non-switching-on (switching off) control using a switching-on switch 331 by the switching-on control circuit 330, and so that the second GCP signal is supplied in synchronization with the switchingon control using the switching-on switch 331 by the switching-on control circuit 330. The switching-on and non-switching-on control by the switching-on control circuit 330 is performed, for example, by a manual switching operation by a user or by an automatic switching operation based on the result of the detection of the intensity of external light. Thereupon, the pulse signal switch 315 is switched in synchronization with this switching-on and non-switching-on control. Therefore, in response to the non-switching-on (switching off) and the switching-on of the light-source lamp 212*a,* it is possible to switch between the setting for the reflective-type display and the setting for the transmissive-type display reliably and without delay.

Such a switching operation in the pulse signal switch 315 may be performed in accordance with a switching-on control signal Smode which is sent from the switching-on control circuit 330 to the switching-on switch 331, as shown in FIG. 10. In addition, the switching operation may be performed in accordance with a detection signal from a detector for detecting that the light-source lamp 212*a* is switched on or it is switched off.

Referring to FIG. 10, the control-power supply circuit 320 comprises an X-side power supply circuit 321 for supplying a control voltage, such as a high-potential voltage (VHX), a low-potential voltage (VLX), or a reference-potential voltage (VCX), used for generating a data signal by the X driver circuit 110, and a Y-side power supply circuit 322 for supplying a control voltage, such as a high-potential voltage (VHY), a low-potential voltage (VLY), or a reference-potential voltage (VCY), used for generating a scanning signal by the Y driver circuit 100.

As shown in FIG. 12, display data in the form of a digital signal formed of a predetermined number of bits, such as six bits, which indicates one level from among, for example, 64 gray scale levels (gray scale levels 0 to 63) is input, for each pixel, to an X driver circuit portion I lOa for supplying a data signal to one data line of the X driver circuit 110 from a data control circuit 313 (see FIG. 10) of the driver control circuit 310. Furthermore, a horizontal synchronization signal HSYNC of the display data, a reference clock XCK for the X driver circuit 110, a RES signal which is a pulse signal generated every selection period, and a FR signal which is a binary signal whose voltage level is inverted at each of the start time and the end time of one selection period are input thereto. Also, voltages VHX, VCX, and VLX, as power for generating a data signal, are supplied from the control-power supply circuit 320 (see FIG. 10). In addition, in this embodiment, in particular, a GCP signal (a first or second GCP signal) is supplied from the pulse signal switch 315 of the driver control circuit 310.

Referring to FIG. 12, the X driver circuit portion 110*a* comprises a shift register 401, a latch circuit 402, a gray-scale control circuit 403, a GCP decoder circuit 404, a FR decoder circuit 405, a level shifter circuit 406, and an LCD driver 408.

When display data is input, the X driver circuit portion 110*a* holds the display-data in sequence in the shift register 401 at intervals of a predetermined number of bits. Since the latch circuit 402, including latch sections having a one-to-one correspondence with a plurality of data lines, performs transferring of the display data to the shift register 401 in sequence, when all the display data for one horizontal line is held, the display data is newly latched to this latch circuit 402.

Here, the GCP decoder circuit 404 generates a signal having a pulse width corresponding to the gray scale level indicated by each display data (digital value) of a predetermined number of bits within the latch circuit 402 in accordance with a GCP signal formed of a train of a predetermined number of pulses per selection period under the control by the gray-scale control circuit 403.

The FR decoder circuit 405 outputs a data signal having a waveform in which the voltage polarity of the signal output of the GCP decoder circuit 404 is inverted for each selection period by using a FR signal which is a binary signal whose voltage level varies for each selection period. More specifically, in accordance with the MSB of the latched display data (digital value), for each selection period, an on/off signal of each transistor which is a constituent of the LCD driver 408 is generated. The reason the voltage level of the data signal corresponding to ON is inverted for each selection period (1 H period) in this manner is for AC-driving the liquid crystal, and the on/off voltage of the scanning signal is also inverted for each 1 H period.

The on/off signal of each transistor within the LCD driver 408, generated in this manner, is shifted to the voltage level corresponding to each data line by the level shifter circuit 406. Then, when the on/off signal in which the voltage level is shifted is input to each gate, each transistor of the LCD driver 408 is turned on/off so that the voltage value of each pulse is set to a voltage value defined by a combination of a plurality of voltages VHX, VCX, and VLX connected to each source or drain.

The X driver circuit 110 (see FIG. 10) comprising the X driver circuit portion 11O*a* constructed as described above holds all digital signals for one horizontal line and supplies them to the plurality of data lines 14 at the same time.

The above operation is further described by referring to the timing chart of FIG. 13.

As shown in FIG. 13, a RES signal is input to the X driver circuit 110 for each selection period, and at the same time, a GCP signal formed of a train of, for example, 62 (=N−2 in the case of 64 gray scales) pulses is input for one selection period, and further, for example, display data (digital signal) which indicates gray scale level 2, gray scale level 5, and gray scale level 0 for a specific pixel is input in field units. Thereupon, in accordance with the GCP signal, the GCP decoder circuit 404 turns on the level of the data signal at the timing of its second and fifth pulses. Then, in accordance with the FR signal, the FR decoder circuit 405 inverts the polarity of the ON voltage or the OFF voltage of the data signal for each selection period, and further, outputs a data signal which takes a predetermined crest value.

In this case, the time-related ratio at which the data signal takes a binary value during one selection period (1H period) and the transmittance of the liquid-crystal panel are, generally, not in a linear relationship. For example, in the case of 64 gray scales, each gray scale level 0 (for example, black), 1, 2, . . . , and 63 (for example, white) obtained when the ON-taking width during 1 H period is varied and the corresponding ON width have such a relationship as that shown in the graph of FIG. 14 due to the characteristics of the liquid crystal, the characteristics of the liquid-crystal panel, and the like. For this reason, in the gray scale display in this embodiment, the ON width of the data signal is varied in accordance with the gray scale level indicated by the input data on the basis of such a relationship. That is, the nearer from the side of gray scale level 0 toward the side of gray scale level 63, the variation rate of the ON width is decreased. Therefore, in order to control the more slight difference of the ON width, as shown in FIG. 11 or in the second stage from the top in FIG. 13, a GCP signal formed of a train of pulses of "number of gray scales—2" (for example, 62 in the case of 64 gray scales) is generated in such a way that intervals are different in correspondence with the difference of the ON width of the data signal in accordance with the difference of the gray scale level. That is, under the relation such as that in FIG. 14, the first and second GCP generation circuits 311 and 312 generate first and second GCP signals formed of a train of 62 pulses in which their intervals become gradually smaller with an increase in the gray scale level, respectively.

In accordance with the GCP signal (first or second GCP signal) having such properties, for example, in FIG. 13, with respect to gray scale level 2, the data signal is turned on (for example, a high voltage level) during only the period from the second pulse from among the GCP signals to the end of the corresponding 1H period within the applicable 1H period. Next, with respect to gray scale level 5, the data signal is turned on (for example, a low voltage level) during only the period from the fifth pulse from among the GCP signals to the end of the corresponding 1H period within the applicable 1 H period. Next, with respect to gray scale level 0, the data signal is turned off (for example, a low voltage level) up to the end of the corresponding 1 H period.

Then, as shown in the lowest stage of FIG. 13, an application signal (which is equal to the scanning signal minus the data signal) applied to one pixel electrode (that is, the pixel electrode connected between one data line to which the display data shown in the figure is supplied and the scanning line (N-the line)) causes the corresponding TFD driving element to exceed the threshold value of the TFD driving element and to be placed in an ON state (low resistance state) in only the period corresponding to the ON width of the corresponding data signal. As a result, an effective voltage corresponding to the ON width of the data signal is applied to the liquid-crystal layer portion sandwiched between the corresponding pixel electrode and the data line or the scanning line.

In a manner as described above, the ON width of the data signal determines the transmittance at each pixel of the liquid-crystal panel, and a display corresponding to the display data is produced as the entire liquid-crystal panel.

As a result of the above, it is possible for the driving device of this embodiment to produce a reflective-type display when the light-source lamp 212*a* is not switched on and to produce a transmissive-type display when the light-source lamp 212*a* is switched on.

Here, in the embodiment, in particular, the pulse signal switch 315 (see FIG. 10) of the driver control circuit 310 switches the setting of each magnitude of the effective value of an applied voltage with respect to each gray scale level in the X driver circuit 110 to a setting for a reflective-type display in response to the nonswitching on of the light-source lamp 212*a* or switches to a setting for a transmissivetype display in response to the switching on of the light-source lamp 212*a*.

Therefore, if the setting (specifically, the setting of intervals of each pulse with respect to the intervals of each gray scale level in the first GCP signal shown in FIG. 11) of each pulse width of the data signal with respect to each gray scale level is performed so that the display becomes brighter over the entire region of each gray scale level as shown by the line C1 for the reflective-type display in comparison with a setting (a single setting) in which there is no distinction between that for the reflective-type display and that for the transmissive-type display as in the conventional case, for example, in comparison of the relationship between the gray scale level and the transmittance of the liquid-crystal panel with a linear relationship shown by the line C0 corresponding to the case of the conventional single setting in the characteristic view of FIG. 15A, the transmittance of the external light in the liquid-crystal panel becomes relatively larger over the entire region of the gray scale level during the reflective-type display. Therefore, the display becomes bright over the entire gray scale. Conversely, in relationship between the gray scale level and the transmittance of liquid crystal panel, if the setting (specifically, the setting of intervals of each pulse with respect to the intervals of each gray scale level in the second GCP signal shown in FIG. 11) of each pulse width of the data signal with respect to each gray scale level is performed so that the display becomes darker over the entire region of each gray scale level as shown by the line C2 for the transmissive-type display in comparison of the linear relationship such as that shown by the line C0 corresponding to the case of the conventional single setting, the transmittance of the external light in the liquid-crystal panel becomes relatively small over the entire region of the gray scale level during the transmissive-type display Therefore, the display becomes dark over the entire gray scale. Therefore, when, in particular, there is no shading film in the liquid-crystal element (see FIGS. 22 and 23), the difference in the contrast ratio and the brightness between during the reflective-type display time and during the transmissive-type display time can be reduced as well, and the variation of the contrast ratio and the brightness when the light source is switched on or when it is switched off can be decreased to such a degree so as not to be very conspicuous or noticeable.

From the viewpoint of increasing the brightness during the reflective-type display time and increasing the contrast ratio during the transmissive-type display time, the setting for the reflective-type display may be set such that the relationship between each gray scale level and the transmittance, such as that shown by the line C1' in FIG. 15B, can be obtained, and the setting for the transmissive-type display may be set such that the relationship between each gray scale level and the transmittance, such as that shown by the lines C2' and C2", can be obtained.

In FIG. 16, the setting for the reflective-type display and the setting for the transmissive-type display are shown in the characteristic view which shows the relationship between the effective value (Veff) of the applied voltage and the transmittance.

FIG. 16 shows an applied voltage area R0 used when the above-mentioned conventional single setting is performed, and applied voltage areas R1 and R1' used when the above-mentioned reflective-type display in which the brightness is increased is set. Further, applied voltage areas R2 and R2' used when the above-mentioned transmissive-type display in which the contrast ratio is increased are shown. By switching the setting of each magnitude of the effective value of the applied voltage with respect to each gray scale level in this manner, an area used as an applied voltage is switched, and finally, a desired transmittance with respect to each gray scale level can be obtained during each of the reflective-type display time and the transmissivetype display time. The specific pulse arrangements of the first and second GCP signals for obtaining an appropriate contrast ratio and brightness are determined in advance by experimental or theoretical simulation, and the like for the liquid-crystal device.

As has been described in the foregoing, according to the liquid-crystal device of the first embodiment, when there is no shading film in the liquid-crystal element 10 (see FIGS. 22 and 23), the setting for the reflective-type display and the setting for the transmissive-type display of the magnitude of the effective value of the applied voltage with respect to each gray scale level are performed in advance so that the difference between the contrast ratio during the reflective-type display time and the contrast ratio during the transmissive-type display time is decreased to that in the conventional case and, preferably, is of the same degree by increasing the contrast ratio during the transmissive-type display time or by decreasing the contrast ratio during the reflective-type display time. As a result, the variation of the contrast ratio when the light-source lamp 212*a* is switched on or when it is switched off (that is, at the time of switching between the reflective-type display mode and the transmissivetype display mode) can be decreased to such a degree so as not to be very conspicuous or noticeable.

In addition, when there is a shading film in the liquid-crystal element 10 (see FIG. 20 and 21), the setting for the reflective-type display and the setting for the transmissive-type display are performed in advance so that the difference between the brightness during the reflective-type display time and the brightness during the transmissive-type display time is decreased to that in the conventional case and, preferably, is of the same degree by decreasing the brightness during the transmissivetype display or by increasing the brightness during the reflective-type display time. As a result, the variation of the brightness when the light-source lamp 212*a* is switched on or when it is switched off can be decreased to such a degree so as not to be very conspicuous or noticeable.

In this embodiment, in particular, a relatively simple switching operation by the pulse signal switch 315 makes it possible to quickly and reliably switch between the reflective-type display mode and the transmissive-type display mode, which is convenient in practice.

Figure 17:
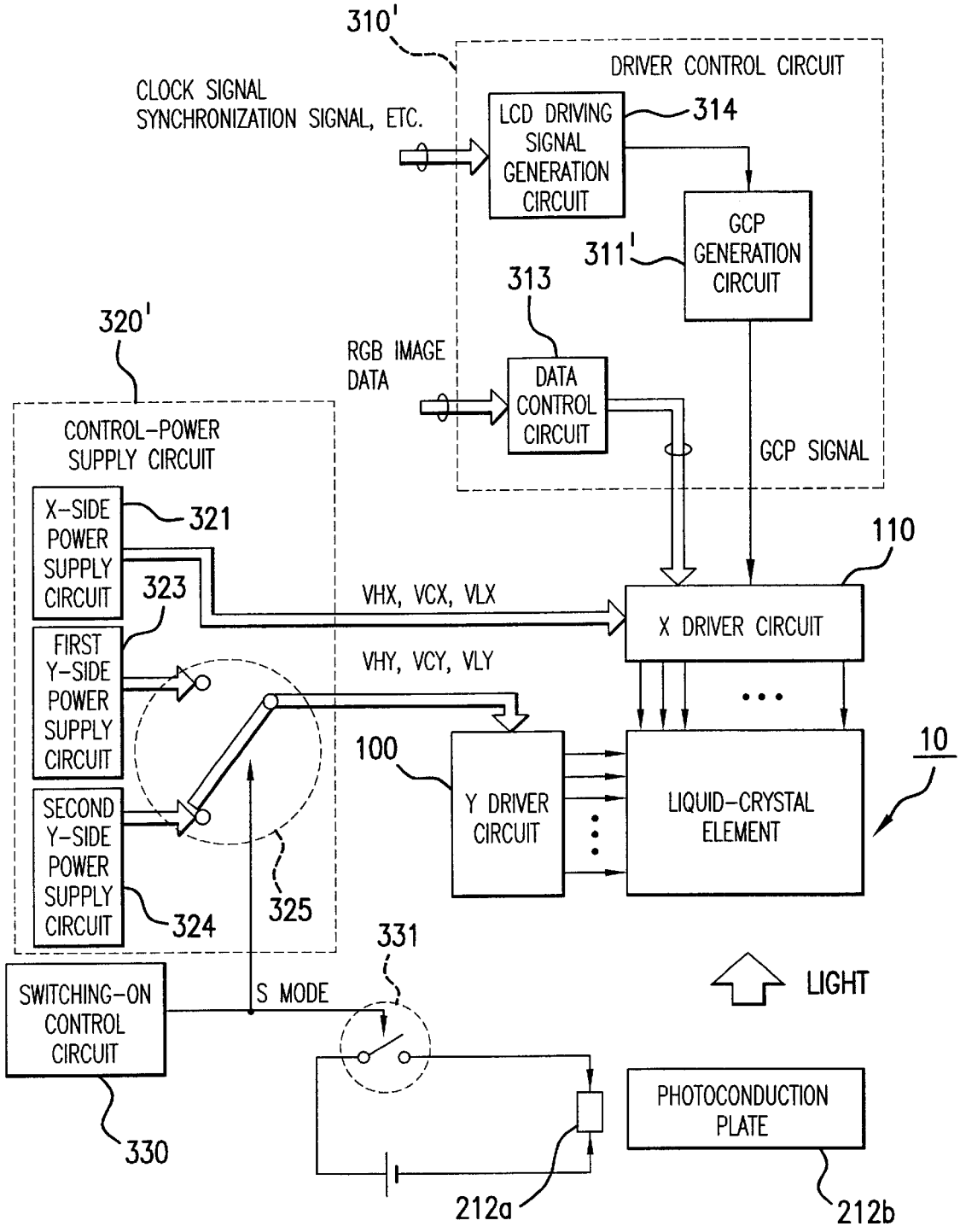
FIG. 17 is a block diagram of a driving device comprising a liquid-crystal panel and a driving device in a second embodiment of the present invention.
Figure 18:
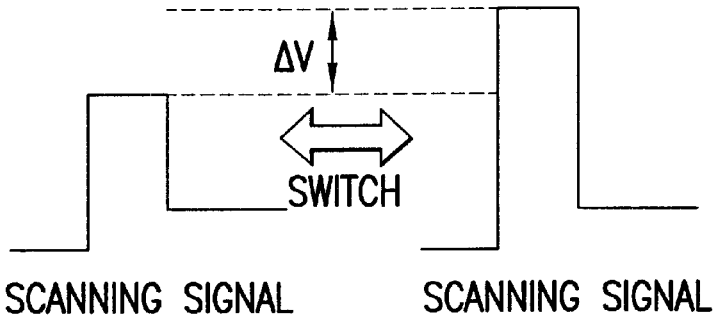
FIG. 18 is a waveform chart of two types of scanning signals generated in the second embodiment of the present invention.
Figure 19:
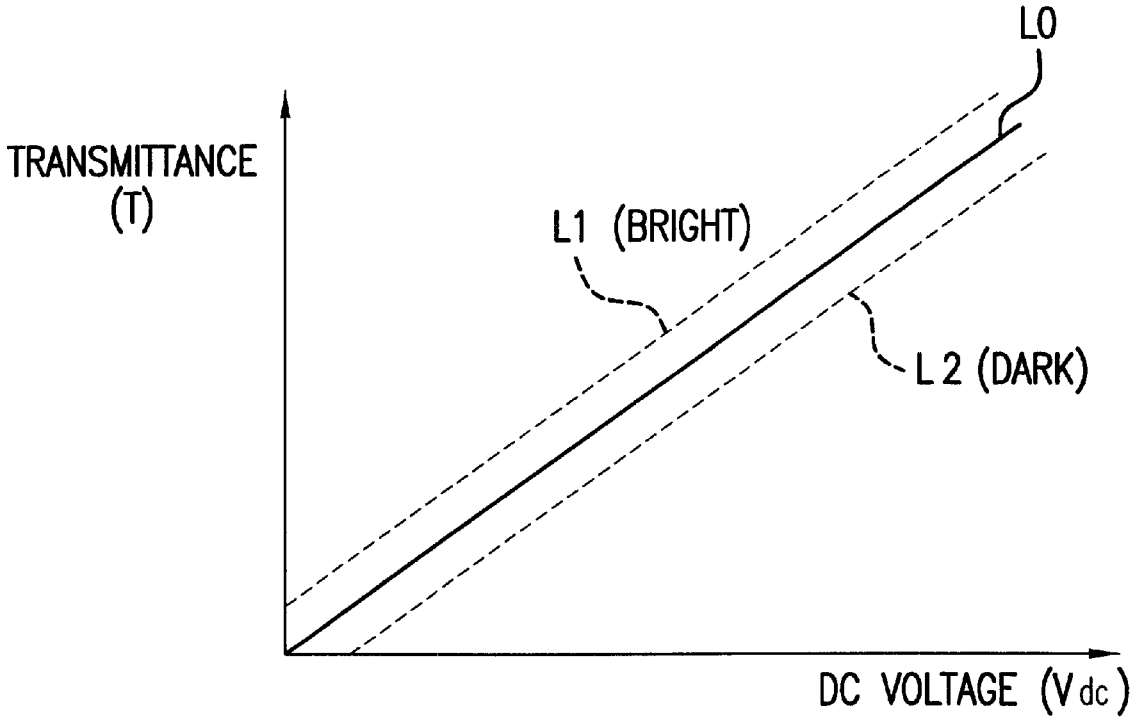
FIG. 19 is a characteristic view showing a relationship between the crest value (DC voltage) of a scanning signal and transmittance in the second embodiment of the present invention.

Next, referring to FIGS. 17 to 19, a description is given of the construction and the operation in a second embodiment of a driving device for driving the abovementioned transflective-type liquid-crystal panel, including the Y driver circuit 100 and the X driver circuit 110 shown in FIG. 8. FIG. 17 is a block diagram specifically showing the construction of the driving device. FIG. 18 is a conceptual view showing the waveforms of two types of scanning signals. FIG. 19 is a characteristic view of transmittance (T) with respect to the crest value (DC voltage) of the scanning signal. Components in FIG. 17 which are the same as those of the first embodiment shown in FIG. 10 are given the same reference numerals, and accordingly, descriptions thereof have been omitted.

As shown in FIG. 17, the driving device comprises a driver control circuit 310' comprising a single GCP generation circuit 311' in place of the first and second GCP generation circuits 311 and 312 and the pulse signal switch 315 in the first embodiment. The driving device comprises a control power supply circuit 320' including first and second Y-side power supply circuits 323 and 324, and a control voltage switch 325 for selectively supplying a control voltage from the first and second Y-side power supply circuits 323 and 324 to the Y driver circuit 100 in place of the control-power supply circuit 320 in the first embodiment. This control voltage switch 325 performs a switching operation in accordance with a switching-on control signal Smode supplied from the switching-on control circuit 330. The remaining construction is the same as that of the first embodiment shown in FIG. 10.

Here, in particular, the control power supply circuit 320' forms another example of a switch. The first Y-side power supply circuit 323 supplies a high-potential voltage (VHY1), a low-potential voltage (VLY1), and a reference-potential voltage (VCY1), which are references for the setting of the crest value of a scanning signal for the reflective-type display, as a set of first control voltages. In contrast, the second Y-side power supply circuit 324 supplies a high-potential voltage (VHY2), a low-potential voltage (VLY2), and a reference-potential voltage (VCY2), which are references for the setting of the crest value of a scanning signal for the transmissivetype display, as an example of a set of second control voltages. The exemplary control voltage switch 325 is constructed in such a manner as to selectively supply a first control voltage to the Y driver circuit 100 in response to the non-switching on of the light-source lamp 212*a* and to selectively supply a second control voltage to the Y driver circuit 100 in response to the switching on of the light-source lamp 212*a*.

Therefore, in the second embodiment, the X driver circuit 110 supplies to the data line a data signal having a pulse width corresponding to the gray scale level. At the same time, the Y driver circuit 100 supplies to the scanning line a scanning signal having a predetermined width and having a crest value corresponding to the first or second control voltage.

FIG. 18 is a waveform chart of an example of two types of scanning signals generated in this manner.

In FIG. 18, the crest value of the scanning signal (right side in the figure) set for the transmissive-type display, generated in accordance with the second control voltage, is higher by ΔV than the crest value of the scanning signal (left side in the figure) set for the reflective-type display, generated in accordance with the first control voltage. Therefore, in the normally white mode, since the voltage value of the applied voltage in the case driven in accordance with the scanning signal during the transmissive-type display time is larger by ΔV, the brightness of the display is decreased. That is, since the voltage value of the applied voltage in the case driven in accordance with the scanning signal during the reflective-type display time is smaller by ΔV, the brightness of the display is increased.

Therefore, the setting (specifically, the setting of the values of the voltages VHY1, VLY1, and VCY1) of the first control voltage is performed so that the display becomes brighter over the entire region of each gray scale level as shown by the line L1 for a reflective-type display, in comparison with a setting (a single setting) in which there is no distinction between that for the reflective-type display and that for the transmissive-type display as in the conventional case, and the relationship between the crest value (DC voltage) of the scanning signal and the transmittance of the liquidcrystal panel shown by of the line LO corresponding to the conventional single setting in the characteristic view of FIG. 19. As a result, during the reflective-type display, since the transmittance of the external light in the liquid-crystal panel becomes relatively large over the entire region of the gray scale level, the display becomes bright over the entire gray scale. Conversely, the setting (specifically, the setting of the values of the voltages VHY2, VLY2, and VCY2) of the second control voltage is performed so that the display becomes darker as shown by the line L2 for a transmissive-type display in comparison of the relationship between the crest value (DC voltage) of the scanning signal and the transmittance of the liquid-crystal panel with the relationship indicated by the line L0 corresponding to the conventional single setting. As a result, during the transmissive-type display, since the transmittance of the external light in the liquid-crystal panel becomes relatively small over the entire region of the gray scale level, the display becomes dark over the entire gray scale. Therefore, when, in particular, there is no shading film (see FIGS. 22 and 23) in the liquid-crystal element, the difference in the contrast ratio and the brightness between the reflective-type display and the transmissive-type display can be reduced as well, and the variation of the contrast ratio and the brightness when the light source is switched on or when it is switched off can be decreased to such a degree so as not to be very conspicuous or to be barely noticeable.

As a result of the above, in a manner similar to the first embodiment, as shown in FIG. 16, by switching the crest value (DC voltage) of the scanning signal, the areas used as applied voltages are switched, and finally, a desired transmittance with respect to each gray scale level can be obtained during each of the reflective-type display time and the transmissive-type display time. Each value of the voltages VHY1, VLY1, VCY1, VHY2, VLY2, and VCY2 which form specific first and second control voltages for obtaining an appropriate contrast ratio and brightness is determined in advance by experimental or theoretical simulation, and the like for the liquid-crystal device. Further, since a driving method (see the lowest stage of FIG. 13) for inverting the applied voltage for each selection period as described above is employed, a high-potential voltage VHY1 (VHY2), a low-potential voltage VLY1 (VLY2), and a reference-potential voltage VCY1 (VCY2) are required. However, as long as the crest values can be switched as shown in FIG. 18, one or two of the three voltages may be the same potential between the first control voltage and the second control voltage. That is, the number of voltages which are switched by a switch in practice may be two or one rather than three. Further, if the above-mentioned inversion driving is not performed, the first and second control voltages may be a pair of voltages.

As has been described in the foregoing, according to the second embodiment, when the setting of the crest value of the scanning signal in the Y driver circuit 100 is switched to a setting for the reflective-type display in response to the non-switching on of the light-source lamp 212*a* or to a setting for the transmissive-type display in response to the switching on of the light-source lamp 212*a,* the setting of each magnitude of the effective value of the applied voltage is switched to a setting for the reflective-type display or to a setting for the transmissive-type display. Therefore, by using the magnitude of the voltage value of the applied voltage based on the difference between the data-signal voltage and the scanning-signal voltage, a bright reflective-type display can be produced during the non-switching on of the lightsource lamp 212*a,* and during the switching on of the light-source lamp 212*a,* a transmissive-type display can be produced at a high contrast ratio. The variation of the contrast ratio when the light source is switched on or when it is switched off can be decreased to such a degree so as not to be very conspicuous or noticeable.

In this embodiment, in particular, a relatively simple switching operation by the control voltage switch 325 makes it possible to quickly and reliably switch between the reflective-type display mode and the transmissive-type display mode, which is convenient in practice.

In each of the above embodiments, gray scale control is performed by modulating the amount of electricity defined by a pulse width and a crest value which form a data signal in such a manner as to correspond to a gray scale level on the basis of a so-called "four-value driving method". In addition, according to the present invention, based on a charging/discharging driving method disclosed in, for example, Japanese Unexamined Patent Publication No. 2-125225, such gray scale control can also be performed.

Furthermore, in each of the above-described embodiments, in place of a liquid-crystal panel for use with a TFD active-matrix driving method, a liquid-crystal panel for use with a simple-matrix driving method or a TFT active-matrix driving method may be driven. In particular, in the case of a liquid-crystal panel for use with a TFT active-matrix driving method, it is possible to reduce the difference in the contrast ratio between the reflective-type display time and the transmissive-type display time, and also to perform gamma correction at the same time.

According to the present invention, a congruous display which is very easy to see can be realized by the transflective-type liquid-crystal device, in which display the brightness and the contrast ratio are appropriately adjusted during both the reflectivetype display time and the transmissive-type display time, and further, the variations of the contrast ratio and the brightness when these display modes are switched are not visually conspicuous.

What is claimed is:

1. A liquid-crystal panel driving device for driving a transflective type liquid-crystal panel, the liquid-crystal panel comprising:

a liquid-crystal element having a liquid crystal held between a pair of substrates and in which an alignment state of the liquid crystal can be varied according to the effective value of an applied voltage applied to the liquid crystal;

a pair of polarized-light separation devices disposed with the liquid-crystal element interposed therebetween;

a light source that causes light-source light to enter the liquid-crystal element via the polarized-light separation devices, a reflective-type display being produced by reflecting external light via the liquid-crystal element and the polarized-light separation devices when the light source is not switched on, and a transmissive-type display being produced by causing the light-source light to be transmitted through the liquid-crystal element and the polarized-light separation devices when the light sources is switched on;

the liquid-crystal panel driving device comprising:

a supply device that supplies to the liquid-crystal element the applied voltage having an effective value of magnitude corresponding to the magnitude of a gray scale level indicated by gray scale data;

a switch that switches a setting of each magnitude of the effective value with respect to each gray scale level in the power supply device to a setting for the reflective-type display in response to the non-switching on of the light source and for switching to a setting for the transmissive-type display in response to the switching on of the light source; and a driver that sets the effective value of the voltage to a value so as to permit one of a contrast ratio and brightness that the liquid-crystal panel displays as a reflective-type and one of a contrast ratio and brightness that the liquid-crystal panel displays as a transmissive-type to be similar to each other, respectively.

2. The liquid-crystal panel driving device according to claim 1, the liquid-crystal element further comprising:

a plurality of data lines, disposed on the substrate, to which a data signal is supplied; and a plurality of scanning lines, disposed on the substrate, to which a scanning signal is supplied, the applied voltage being applied to the liquid crystal for each liquid-crystal portion in each pixel in such a manner as to correspond to at least one of the data signal and the scanning signal which are supplied via the data lines and the scanning lines, respectively.

3. The liquid-crystal panel driving device according to claim 1, the supply device further comprising:

a data-signal supply device that supplies to the data lines a data signal having a pulse width corresponding to the gray scale level.

4. The liquid-crystal panel driving device according to claim 1, the switch switching a setting of the magnitude of the effective value so that, in the setting for the reflective-type display, a transmittance of an external light in the liquid-crystal device becomes relatively large over an entire region of the gray scale level, and that in the setting for the transmissive-type display, a transmittance of the light-source light in the liquid-crystal device becomes relatively small over the entire region of the gray scale level.

5. The liquid-crystal panel driving device according to claim 1, the switch switching a setting of the magnitude of the effective value so that, in the setting for the reflective-type display, a variation of a transmittance of an external light in the liquid-crystal device with respect to a variation of the gray scale level becomes relatively small, and that in the setting for the transmissive-type display, a variation of a transmittance of the light-source light with respect to the variation of the gray scale level in the liquid-crystal device becomes relatively large.

6. The liquid-crystal panel driving device according to claim 1, further comprising:

a switching-on control device that controls switching on and non-switching on of the light source, the switch switching a setting of a magnitude of the effective value in synchronization with the control of switching on and non-switching on by the switching-on control device.

7. A liquid-crystal device comprising:

the liquid-crystal panel driving device according to claim 1; and a liquid-crystal panel.

8. The liquid-crystal device according to claim 7, the liquid-crystal element comprising:

a plurality of data lines, disposed on the substrate, to which a data signal is supplied;

a plurality of scanning lines, disposed on the substrate, to which a scanning signal is supplied; and a plurality of two-terminal-type nonlinear elements, which are connected in series, respectively, together with a liquid-crystal portion in each pixel, between the plurality of data lines and the plurality of scanning lines.

9. The liquid-crystal device according to claim 8, the two-terminal-type nonlinear element comprising a TFD (Thin Film Diode) driving element.

10. The liquid-crystal device according to claim 7, the pair of polarized-light separation devices being formed of a pair of polarizers disposed so as for their transmission axes to form a predetermined angle.

11. The liquid-crystal device according to claim 10, the liquid-crystal panel further comprising:

a transflector disposed on a side opposite to the liquid-crystal element with respect to one of the pair of polarizers.

12. The liquid-crystal device according to claim 11, the light source causing the light-source light to enter the liquid-crystal element via the transflector and the one polarizer of the pair of polarizers.

13. A liquid-crystal panel driving device for driving a transflective type liquid-crystal panel, the liquid-crystal panel comprising:

a liquid-crystal element having a liquid crystal held between a pair of substrates and in which an alignment state of the liquid crystal can be varied according to the effective value of an applied voltage applied to the liquid crystal;

a pair of polarized-light separation devices disposed with the liquid-crystal element interposed therebetween;

a light source that causes light-source light to enter the liquid-crystal element via the polarized-light separation devices, a reflective-type display being produced by reflecting external light via the liquid-crystal element and the polarized-light separation devices when the light source is not switched on, and a transmissive-type display being produced by causing the light-source light to be transmitted through the liquid-crystal element and the polarized-light separation devices when the light source is switched on;

the liquid-crystal panel driving device comprising:

a supply device that supplies to the liquid-crystal element the applied voltage having an effective value of a magnitude corresponding to the magnitude of a gray scale level indicated by gray scale data; and a switch that switches a setting of each magnitude of the effective value with respect to each gray scale level in the power supply device to a setting for the reflective-type display in response to the non-switching on of the light source and for switching to a setting for the transmissive-type display in response to the switching on of the light source;

the liquid-crystal element further comprising:

a plurality of data lines, disposed on the substrate, to which a data signal is supplied; and a plurality of scanning lines, disposed on the substrate, to which a scanning signal is supplied, the applied voltage being applied to the liquid crystal for each liquid-crystal portion in each pixel in such a manner as to correspond to at least one of the data signal and the scanning signal which are supplied via the data lines and the scanning lines, respectively;

the supply device further comprising:

a data-signal supply device that supplies to the data lines a data signal having a pulse width corresponding to the gray scale level;

the switch switching the setting of each pulse width of the data signal with respect to each gray scale level in the data-signal supply device to a setting for a reflective-type display in response to the non-switching on of the light source and to a setting for a transmissive-type display in response to the switching on of the light source, thereby switching the setting of each magnitude of the effective value.

14. The liquid-crystal panel driving device according to claim 13, the switch further comprising:

a first pulse generator that generates a first pulse signal for gray scale control, formed of a plurality of pulses, arranged in such a manner as to correspond to intervals of the gray scale level which is a reference for the setting of the pulse width for the reflective-type display;

a second pulse generator that generates a second pulse signal for gray scale control, formed of a plurality of pulses, arranged in such a manner as to correspond to the intervals of the gray scale level which is a reference for the setting of the pulse width for the transmissive-type display; and a pulse signal switch that selectively supplies the first pulse signal for gray scale control to the data-signal supply device in response to the non-switching on of the light source and that selectively supplies the second pulse signal for gray scale control in response to the switching on of the light source to the data-signal supply device.

15. A liquid-crystal panel driving device for driving a transflective type liquid-crystal panel, the liquid-crystal panel comprising:

a liquid-crystal element having a liquid crystal held between a pair of substrates and in which an alignment state of the liquid crystal can be varied according to the effective value of an applied voltage applied to the liquid crystal;

a pair of polarized-light separation devices disposed with the liquid-crystal element interposed therebetween;

a light source that causes light-source light to enter the liquid-crystal element via the polarized-light separation devices, a reflective-type display being produced by reflecting external light via the liquid-crystal element and the polarized-light separation devices when the light source is not switched on, and a transmissive-type display being produced by causing the light-source light to be transmitted through the liquid-crystal element and the polarized-light separation devices when the light source is switched on;

the liquid-crystal panel driving device comprising:

a supply device that supplies to the liquid-crystal element the applied voltage having an effective value of a magnitude corresponding to the magnitude of a gray scale level indicated by gray scale data; and a switch that switches a setting of each magnitude of the effective value with respect to each gray scale level in the power supply device to a setting for the reflective-type display in response to the non-switching on of the light source and for switching to a setting for the transmissive-type display in response to the switching on of the light source;

the liquid-crystal element further comprising:

a plurality of data lines, disposed on the substrate, to which a data signal is supplied; and a plurality of scanning lines, disposed on the substrate, to which a scanning signal is supplied, the applied voltage being applied to the liquid crystal for each liquid-crystal portion in each pixel in such a manner as to correspond to at least one of the data signal and the scanning signal which are supplied via the data lines and the scanning lines, respectively;

the supply device further comprising:

a data-signal supply device that supplies to the data lines a data signal having a pulse width corresponding to the gray scale level;

the switch switching the setting of each pulse width of the data signal with respect to each gray scale level in the data-signal supply device to a setting for a reflective-type display in response to the non-switching on of the light source and to a setting for a transmissive-type display in response to the switching on of the light source, thereby switching the setting of each magnitude of the effective value.

a light source that causes light-source light to enter the liquid-crystal element via the polarized-light separation devices, a reflective-type display being produced by reflecting external light via the liquid-crystal element and the polarized-light separation devices when the light source is not switched on, and a transmissive-type display being produced by causing the light-source light to be transmitted through the liquid-crystal element and the polarized-light separation devices when the light source is switched on;

the liquid-crystal panel driving device comprising:

a supply device that supplies to the liquid-crystal element the applied voltage having an effective value of a magnitude corresponding to the magnitude of a gray scale level indicated by gray scale data; and a switch that switches a setting of each magnitude of the effective value with respect to each gray scale level in the power supply device to a setting for the reflective-type display in response to the non-switching on of the light source and for switching to a setting for the transmissive-type display in response to the switching on of the light source, without inverting the relationship between the gradation level and the transmittance;

the liquid-crystal element further comprising:

a plurality of data lines, disposed on the substrate, to which a data signal is supplied; and a plurality of scanning lines, disposed on the substrate, to which a scanning signal is supplied, the applied voltage being applied to the liquid crystal for each liquid-crystal portion in each pixel in such a manner as to correspond to at least one of the data signal and the scanning signal which are supplied via the data lines and the scanning lines, respectively;

the supply device comprising:

a data-signal supply device that supplies a data signal having a pulse width corresponding to the gray scale level to the data lines; and a scanning-signal supply device that supplies a scanning signal having a predetermined width to the scanning lines.

16. The liquid-crystal panel driving device according to claim 15, the switch switching a setting of a crest value of the scanning signal in the scanning-signal supply device to a setting for a reflective-type display in response to the non-switching on of the light source and to a setting for a transmissive-type display in response to the switching on of the light source, thereby switching the setting of each magnitude of the effective value.

17. The liquid-crystal panel driving device according to claim 16, the switch comprising:

a first control voltage supply device that supplies a first control voltage which is a reference for the setting of the crest value for the reflective-type display;

a second control voltage supply device that supplies a second control voltage which is a reference for the setting of the crest value for the transmissive-type display; and a control voltage switch that selectively supplies the first control voltage to the scanning-signal supply device in response to the non-switching on of the light source and for selectively supplying the second control voltage to the scanning-signal supply device in response to the switching on of the light source.

18. A liquid-crystal panel driving device for driving a liquid-crystal element in a transflective type liquid-crystal panel by supplying thereto a voltage having an effective value corresponding to a gray scale level defined by gray scale data, the liquid-crystal panel driving device comprising:

a driver that sets the effective value of the voltage to a value so as to permit one of a contrast ratio and a brightness that the liquid-crystal panel displays as a reflectivetype and the one of the contrast ratio and brightness that the liquid-crystal panel displays as a transmissive-type to be similar to each other, respectively.

19. A liquid-crystal panel driving device as set forth in claim 18, wherein the driver sets the effective value of the voltage to one of a value so as to permit the contrast ratio displayed in the reflective-type to decrease and a value so as to permit the contrast ratio displayed in the transmissive-type to increase.

20. A liquid-crystal panel driving device as set forth in claim 18, wherein the driver sets the effective value of the voltage to one of a value so as to permit the brightness displayed in the reflective-type to increase and a value so as to permit the brightness displayed in the transmissive-type to decrease.

21. A liquid crystal device comprising:

the liquid-crystal panel driving device according to claims 18; and a liquid-crystal panel.

22. A liquid-crystal panel driving device for driving a liquid-crystal element in a transflective type liquid-crystal panel by supplying thereto a voltage having an effective value corresponding to a gray scale level defined by gray scale data, the liquid-crystal panel driving device comprising:

a switch that switches a setting of a relationship between a gradation level and a transmittance, which differs for a reflective-type display and a transmissive-type display without inverting the relationship between the gradation level and the transmittance.

23. The liquid-crystal panel driving device according to claim 22, the relationship having the feataure that the trasmittance for the reflective-type display is higher than the transmittance for the transmissive-type display for a same halftone gradation level.

24. A liquid-crystal device comprising:

the liquid-crystal panel driving device according to claim 22; and a liquid-crystal panel.

25. A liquid-crystal panel driving device for driving a transflective type liquid-drystal panel, the liquid-crystal panel comprising:

a liquid-crystal element having a liquid crystal held between a pair of substrates and in which an alignment state of the liquid crystal can be varied according to the effective value of an applied voltage applied to the liquid crystal;

a pair of polarized-light separation devices disposed with the liquid-crystal element interposed therebetween;

a light source that causes light-source light to enter the liquid-crystal element via the polarized-light separation devices, a reflective-type display being produced by reflecting external light via the liquid-crystal element and the polarized-light separation devices when the light source is not switched on, and a transmissive-type display being produced by causing the light-source light to be transmitted through the liquid-crystal element and the polarized-light separation devices when the light sources is switched on;

the liquid-crystal panel driving device comprising:

a supply device that supplies to the liquid-crystal element the applied voltage having an effective value of a magnitude corresponding to the magnitude of a gray scale level indicated by gray scale data;

a first switch that switches a setting of each magnitude of the effective value with respect to each gray scale level in the power supply device to a setting for the reflective-type display in response to the non-switching on of the light source and for switching to a setting for the transmissive-type display in response to the switching on of the light source; and a second switch that switches a setting of a relationship between a gradation level and a transmittance, which differs for the reflective-type display and the transmissive-type display without inverting the relationship between the gradation level and the transmittance.

26. The liquid-crystal panel driving device according to claim 25, the relationship having the feature that the transmittance for the reflective-type display is higher than the transmittance for the transmissive-type display for a same halftone gradation level.

27. A liquid-crystal device comprising:

the liquid-crystal panel driving device according to claim 25; and a liquid-crystal panel.

* * * * *